US006266038B1

(12) United States Patent
Yoshida et al.

(10) Patent No.: US 6,266,038 B1
(45) Date of Patent: Jul. 24, 2001

(54) LIQUID CRYSTAL DISPLAY APPARATUS

(75) Inventors: Daisuke Yoshida, Ebina; Katsumi Kurematsu, Hiratsuka; Osamu Koyama, Hachioji, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/186,204

(22) Filed: Nov. 4, 1998

(30) Foreign Application Priority Data

Nov. 7, 1997 (JP) ..... 9-305576

(51) Int. Cl.[7] ..... G09G 3/36

(52) U.S. Cl. ..... 345/92; 345/90; 345/93; 345/96; 345/100

(58) Field of Search ..... 345/90, 92, 96, 345/100; 395/90, 92, 93, 96, 100

(56) References Cited

U.S. PATENT DOCUMENTS

| | | | | |
|---|---|---|---|---|
| 4,981,340 | | 1/1991 | Kurematsu et al. | 350/333 |
| 5,227,900 | | 7/1993 | Inaba et al. | 359/56 |
| 5,251,050 | | 10/1993 | Kurematsu et al. | 359/57 |
| 5,333,004 | * | 7/1994 | Mourey et al. | 345/92 |
| 5,436,635 | * | 7/1995 | Takahara et al. | 345/92 |
| 5,515,072 | * | 5/1996 | Yanai et al. | 345/92 |
| 5,576,857 | | 11/1996 | Takemura | 359/59 |
| 5,642,213 | * | 6/1997 | Mase et al. | 349/43 |
| 5,680,147 | * | 10/1997 | Yamazaki et al. | 345/94 |
| 5,706,021 | | 1/1998 | Kurematsu | 345/89 |
| 5,796,380 | | 8/1998 | Kurematsu | 345/96 |
| 5,816,677 | | 10/1998 | Kurematsu et al. | 362/31 |
| 5,903,249 | * | 5/1999 | Komaya et al. | 345/92 |
| 5,933,205 | * | 8/1999 | Yamazaki et al. | 349/43 |
| 5,959,599 | * | 9/1999 | Hirakata | 345/92 |
| 6,011,532 | * | 1/2000 | Yanai et al. | 345/92 |

FOREIGN PATENT DOCUMENTS

| | | |
|---|---|---|
| 0506530 | 9/1992 | (EP) . |
| WO 94/08331 | 4/1994 | (WO) . |

* cited by examiner

*Primary Examiner*—Almis R. Jankus
*Assistant Examiner*—Henry N. Tran
(74) *Attorney, Agent, or Firm*—Fitzpatrick, Cella, Harper & Scinto

(57) ABSTRACT

An active matrix type liquid crystal display apparatus can be driven with a low voltage, a reduced power consumption rate and a reduced circuit size without sacrificing the quality of the image it displays. It comprises a plurality of vertical signal lines, a substrate carrying thereon a plurality of pixel electrodes connected to the respective crossings of the plurality of vertical signal lines and the plurality of scanning lines by way of respective transistors, a counter electrode substrate carrying thereon a counter electrode and liquid crystal pinched between the substrate and the counter substrate and is characterized in that two transistors of different conductivity types are connected to each of the pixel electrodes and the source electrode or the drain electrode and the gate electrode of the transistor of the first conductivity type are connected respectively to a first vertical signal line and a first scanning line, whereas the source electrode or the drain electrode, whichever appropriate, and the gate electrode of the transistor of the second conductivity type different from the first conductivity type are connected respectively to a second vertical signal line and a second scanning line.

11 Claims, 19 Drawing Sheets

| | | | | | | | | | | | |
|---|---|---|---|---|---|---|---|---|---|---|---|
| R | G | B | R | G | B | R | G | B | R | G | B |
| R | G | B | R | G | B | R | G | B | R | G | B |
| R | G | B | R | G | B | R | G | B | R | G | B |
| R | G | B | R | G | B | R | G | B | R | G | B |
| R | G | B | R | G | B | R | G | B | R | G | B |

LIQUID CRYSTAL DISPLAY APPARATUS

BACKGROUND OF THE INVENTION

1. Field of the Invention

This invention relates to an active matrix type liquid crystal display apparatus and, more particularly, it relates to an active matrix type liquid crystal display apparatus having a plurality of vertical signal lines and a plurality of switching transistors arranged for the liquid crystal device of each pixel.

2. Related Background Art

Known methods developed in recent years for driving liquid crystal display apparatus to display images include simple matrix drive methods typically to be conducted in a TN display mode, an STN display mode or a ferroelectric liquid crystal display mode, di-terminal type active matrix drive methods using MIMs or diodes and tri-terminal type active matrix drive methods using a-Si TFTs or poly-Si TFTS.

Meanwhile, known methods for driving liquid crystal panels include line-sequential scanning methods adapted to rewrite the voltage of all the pixels of a row in a single horizontal scanning period and dot-sequential scanning methods adapted to serially rewrite the voltage of each pixel. When a liquid rystal panel is driven by a DC voltage, electrochemical reactions are apt to occur in the liquid crystal material, the oriented film and/or the interface thereof to degrade the quality of the displayed image. A technique of polarity inversion of data signals or that of applying an AC to drive the liquid crystal panel is popularly used to avoid this problem. The AC drive technique utilizes both a line inversion system of inverting the polarity on a scanning line by scanning line basis and a field inversion system of inverting the polarity on a field by field basis in order to prevent inter-frame flickers and inter-line flickers from taking place.

FIG. 6 of the accompanying drawings schematically illustrates a circuit diagram of a pixel of a known active matrix circuit. Referring to FIG. 6, there are shown a vertical signal line 61, a scanning line 62 and a switching pixel transistor 63. Reference symbol Cadd denotes a holding capacitance and reference symbol LC denotes liquid crystal. Note that the switching pixel transistor 63 is an n-channel type transistor. A known active matrix circuit having the above described configuration is accompanied by the problems as pointed out below because the pixel transistor 63 is an n-channel type transistor.

The AC drive technique is normally used in liquid crystal display apparatus in order to prevent degradation (the sticking phenomenon) of the liquid crystal LC of the apparatus. Then, the image signal applied thereto can show either a positive polarity or a negative polarity relative to the middle potential as shown in FIG. 7A and hence it is required to have a large amplitude. Then, as shown in FIG. 7B, the pulse of the scanning line 62 is required to have an even larger amplitude obtained by adding an amplitude corresponding to a threshold value of transistor 63 to that of the image signal. Furthermore, the apparent threshold value of the transistor 63 is raised as the source potential of the transistor 63 rises because of the back bias effect. Then, the amplitude of the pulses of the scanning line 62 becomes even larger if the biasing effect is taken into consideration so that consequently a high supply voltage is required to drive the circuit. The use of such a high voltage inevitably raise the power consumption rate.

FIG. 8 schematically illustrates a circuit diagram of a pixel of another known active matrix circuit. Referring to FIG. 8, the pixel comprises a signal line 61, a scanning line 64, a scanning line inverse relative to the scanning line 65, an n-channel type pixel transistor 66, a p-channel type pixel transistor 67, a holding capacitance Cadd and liquid crystal LC. With such a circuit configuration, no additional amplitude corresponding to a threshold value is required and hence it suffices that the scanning line 64 has an amplitude substantially same as that of the image signal applied thereto because the ON-state resistance of the n-channel type transistor 67 is raised while that of the p-channel type transistor 66 is lowered in a range where the signal voltage is high, whereas the ON-state resistance of the n-channel type transistor 66 is lowered while that of the p-channel type transistor 67 is raised in a range where the signal voltage is low so that a constant ON-state resistance is realized over the entire range of change of the signal voltage.

In the above described active matrix circuit, both the n-channel type transistor 66 and the p-channel type transistor 67 are turned on simultaneously under any circumstances. However, it is sufficient to turn on only the p-channel type transistor 67 when an image signal (with a positive polarity) having a voltage higher than the middle potential is written onto a pixel and only the n-channel type transistor 66 when an image signal (with a negative polarity) having a voltage lower than the middle potential is written onto a pixel. It is not desirable to turn on the two transistors simultaneously from the viewpoint of reducing the power consumption rate.

FIG. 9A shows a circuit diagram of a circuit adapted to transfer a signal to vertical signal lines 90, 91. Referring to FIG. 9A, image signal (1) is fed to polarity inversion circuit 81, which forwards the signal to common communication signal line 87 to turn on/off CMOS transfer switches 83, 84 according to control signals 88, 89 from horizontal scanning circuit 82 and by way of inverters 85, 86 so that the image signal is output to vertical signal lines 90, 91 in an alternate fashion.

Now, as described above, a signal having its polarity inverted regularly and periodically has to be fed to the vertical signal lines 90, 91. Referring to FIG. 9B, the image signal (1) is transformed to show a waveform illustrated by (3) according to a polarity inversion signal INV (2). For the reason described above by referring to FIG. 8, CMOS transfer switches are preferably used for the transfer switches 83, 84 so that the signal may be transferred without losing its amplitude. Thus, with any of the above described known techniques, a complicated signal processing circuit is required to invert an image signal according to a polarity inversion signal INV (2) and, additionally, CMOS transfer switches have to be used for the transfer switches 83, 84 to consequently increase the circuit size.

SUMMARY OF THE INVENTION

In view of the above identified problems, it is therefore the object of the present invention to provide an active matrix type liquid crystal display apparatus that can be driven with a low voltage, a reduced power consumption rate and a reduced circuit size without sacrificing the quality of the image it displays.

According to a first aspect of the invention, the above object is achieved by providing an active matrix type liquid crystal display apparatus comprising a plurality of vertical signal lines (14, 15), a plurality of scanning lines (16, 17), a plurality of pixel electrode substrates carrying thereon respective pixel electrodes (13) arranged at the crossings of the vertical signal lines and the scanning lines, a counter electrode substrate and liquid crystal pinched between the pixel electrode substrates and the counter substrate, characterized in that each of the pixel electrodes is connected to a pair of vertical signal lines selected from the vertical signal lines by way of a pair of switching devices (11, 12), which switching devices are connected respectively to a pair of scanning lines (16, 17), the pair of vertical signal lines (14, 15) being adapted to individually supply a positive polarity image signal and a negative polarity image signal, the pair of scanning lines being adapted to alternately open and close the pair of switches so that, while the positive polarity image signal is fed to the pixel electrode from one (15) of the pair of vertical signal lines by way of the corresponding one (12) of the pair of switches closed by the scan signal from one (17) of the pair of scanning lines, the scan signal from the other (16) of the pair of scanning lines opens the other (11) of the pair of switches to shut off the negative polarity image signal from the other (14) of the pair of vertical signal lines and, while the negative polarity image signal is fed to the pixel electrode from the other (14) of the pair of vertical signal lines by way of the corresponding other (11) of the pair of switches closed by the scan signal from the other (16) of the pair of scanning lines, the scan signal from the one (17) of the pair of scanning lines opens the one (12) of the pair of switches to shut off the positive polarity image signal from the one (15) of the pair of vertical signal lines.

According to a second aspect of the invention, there is provided an active matrix type liquid crystal display apparatus comprising a plurality of vertical signal lines, a substrate carrying thereon a plurality of pixel electrodes connected to the respective crossings of the plurality of vertical signal lines and the plurality of scanning lines by way of respective transistors, a counter electrode substrate carrying thereon a counter electrode and liquid crystal pinched between the substrate and the counter substrate, characterized in that at least two transistors of different conductivity types are connected to each of the pixel electrodes and the source electrode or the drain electrode and the gate electrode of the transistor of the first conductivity type are connected respectively to a first vertical signal line and a first scanning line, whereas the source electrode or the drain electrode, whichever appropriate, and the gate electrode of the transistor of the second conductivity type different from the first conductivity type are connected respectively to a second vertical signal line and a second scanning line.

Preferably, an active matrix type liquid crystal display apparatus according to the second aspect of the invention further comprises a control means adapted to select the first (second) scanning line to bring the transistor of the first conductivity type into a conducting state and, simultaneously, the second (first) scanning line of an adjacent row to bring the transistor of the second (first) conductivity type into a conducting state.

Preferably, in an active matrix type liquid crystal display apparatus according to the first aspect of the invention, the transfer switch for transferring the image signal to the first vertical signal line connected to the source electrode or the drain electrode of the transistor of the first conductivity type comprises a transistor of the first conductivity type, whereas the transfer switch for transferring the image signal to the second vertical signal line connected to the source electrode or the drain electrode, whichever appropriate, of the transistor of the second conductivity type comprises a transistor of the second conductivity type.

With the above arrangement, an active matrix type liquid crystal display apparatus that can be driven with a low voltage, a reduced power consumption rate and a reduced circuit size can be realized without sacrificing the quality of the image it displays.

According to a third aspect of the invention, there is provided an active matrix type liquid crystal display apparatus comprising a plurality of vertical signal lines, a plurality of pixel electrodes connected respectively to the crossings of the plurality of vertical signal lines and the plurality of scanning lines by way of respective switches, a counter electrode disposed vis-a-vis the pixel electrodes and liquid crystal pinched between the pixel electrodes and the counter electrode, characterized in that each of switches comprises at least two transistors of different conductivity types, the principal electrode of the transistor of the first conductivity type being connected to a first vertical signal line, the control electrode of the transistor of the first conductivity type being connected to a first scanning line, the principal electrode of the transistor of the second conductivity type different from the first conductivity type being connected to a second vertical signal line, the control electrode of the transistor of the second conductivity type being connected to a second scanning line, the first and second vertical signal lines and the first scanning line and the second scanning line of an-adjacent row having polarities inverted relative to each other.

With the above arrangement, it is now possible to feed image signals with inverted polarities to the pixel electrodes at a low power consumption rate to display high quality images that are free from flickers.

According to a still another aspect of the invention, there is provided a projection type liquid crystal display apparatus comprising a liquid crystal display apparatus as defined above. The projection type liquid crystal display apparatus further comprises at least three liquid crystal panels for the three primary colors, wherein blue light is separated by a high reflection mirror and a blue light reflecting dichroic mirror and red light and green light are separated by a red light reflecting dichroic mirror and a green/blue light reflecting dichroic mirror before projected onto the respective liquid crystal panels.

DETAILED DESCRIPTION OF THE PREFERRED EMBODIMENTS

Now, the present invention will be described in greater detail by referring to the accompanying drawings that illustrate preferred embodiments of the invention.

[First Embodiment]

Figure 1:
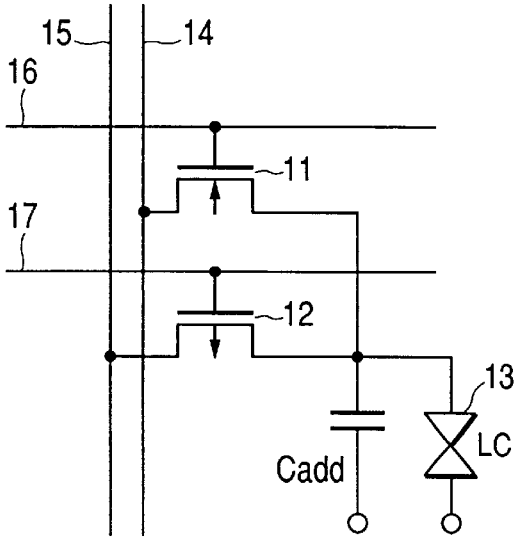
FIG. 1 is an equivalent circuit diagram of a first embodiment of the invention.

FIG. 1 is an equivalent circuit diagram of a first embodiment of the invention. Referring to FIG. 1, there are shown an n-channel type transistor 11 operating as pixel switch, a p-channel type transistor 12 also operating as pixel switch, a pixel electrode 13 for applying a video signal to liquid crystal LC and holding capacitance Cadd, vertical signal lines 14, 15 and scanning lines 16, 17. In this embodiment the drain electrodes (or the source electrodes) of two transistors 11, 12 of different conductivity types are connected to each pixel electrode 13 and the source electrodes (or the drain electrodes, whichever appropriate) of the transistors 11, 12 are connected to the respective vertical signal lines 14, 15. Additionally, the gate electrodes of the transistors 11, 12 are connected to the respective scanning lines 16, 17.

A liquid crystal display apparatus is typically driven by an AC in order to prevent the liquid crystal of the apparatus from degradation. In this embodiment, the scanning line 17 is selected to turn on only the p-channel type transistor 12 when a signal (to be referred to as positive polarity image signal hereinafter) with a voltage higher than the middle potential (counter electrode potential) is applied to the pixel electrode 13 so that the signal may be written onto the pixel electrode 13 from the vertical signal line 15.

By the same token, the scanning line 16 is selected to turn on only the n-channel type transistor 11 when a signal (to be referred to as negative polarity image signal hereinafter) with a voltage lower than the middle potential is applied to the pixel electrode 13 so that the signal may be written onto the pixel electrode 13 from the vertical signal line 14. With this arrangement, it is now possible to invert the signal polarity to display images in a stable fashion and reduce both the supply voltage and the power consumption rate because only the p-channel type transistor 12 is turned on for writing a positive polarity image signal whereas only the n-channel type transistor 13 is turned on for writing a negative polarity image signal.

[Second Embodiment]

Figure 3:
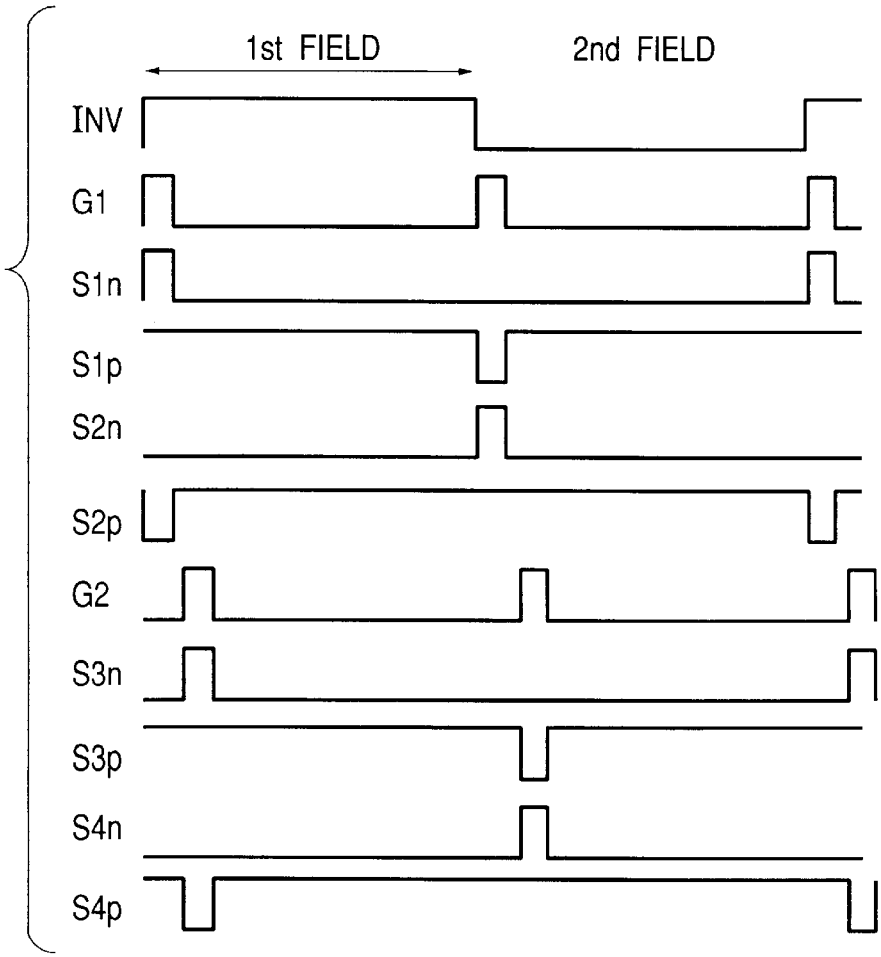
FIG. 3 is a timing chart illustrating the operation of the second embodiment of the invention.
Figure 2:
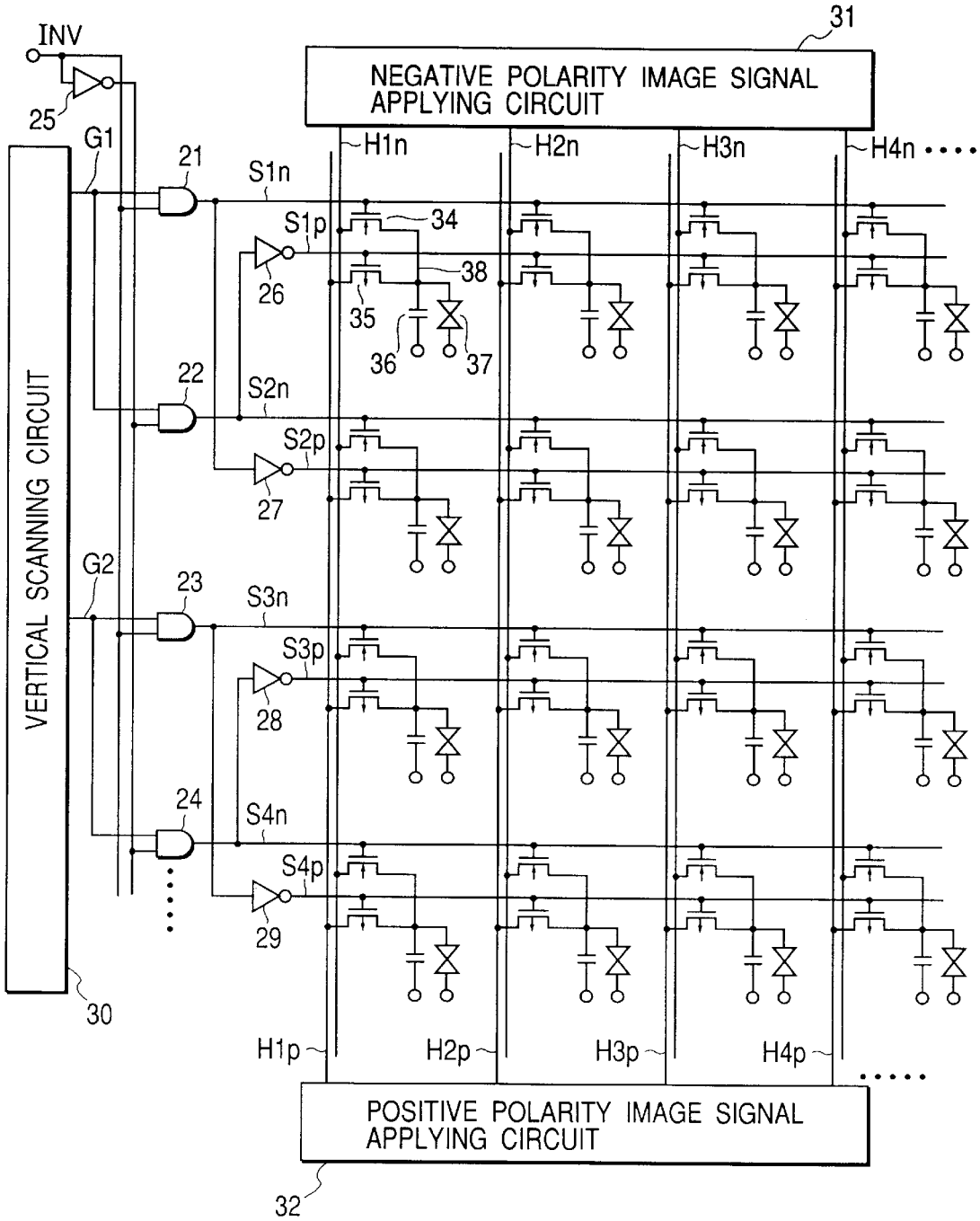
FIG. 2 is an equivalent circuit diagram of a second embodiment of the invention.

FIG. 2 is an equivalent circuit diagram of a second embodiment of the invention. In FIG. 2, reference symbols G1 and G2 denote outputs of vertical scanning circuit 30 and reference symbol INV denotes a polarity inversion signal. Reference symbols H1*n* through H4*n* and H1*p* through H4*p* denote respective vertical signal lines, whereas reference numerals 21 through 24 denote respective AND-gates. Reference numerals 25 through 29 denote respective INV-gates. Reference numerals 31 and 32 respectively denote negative and positive polarity image signal applying circuits and reference numeral 34 denotes an n-channel type MOS switch transistor operating as pixel switch, whereas reference numeral 35 denotes a p-channel type MOS switch transistor also operating as pixel switch. Reference numeral 36 denotes a holding capacitance and reference numeral 37 denotes liquid crystal, whereas reference numeral 38 denotes a pixel electrode for applying a voltage to the liquid crystal as a function of the input image signal. Since the components of the pixel operate same as their counterparts of the first embodiment, they will not be described any further. FIG. 3 is a timing chart illustrating the operation of the second embodiment of the invention.

Referring to FIG. 2, scanning lines S1*n*, S3*n* to which the gate electrodes of the n-channel type transistors 34 on the odd lines are connected are respectively connected to scanning lines S2*p*, S4*p* to which the gate electrodes of the p-channel type transistors 35 on the adjacent even lines are connected by way of respective INV-gates 27, 29. Similarly, scanning lines, S2*n*, S4*n* to which the gate electrodes of the n-channel type transistors 34 on the even lines are connected are respectively connected to scanning lines S1*p*, S3*p* to which the gate electrodes of the p-channel type transistors 35 on the adjacent odd lines are connected by way of respective INV-gates 26, 28. With this arrangement, transistors with different conductivity types are turned on simultaneously on any adjacently located two lines.

Meanwhile, a negative polarity image signal is applied to the vertical signal lines H1*n* through H4*n* from the negative polarity image signal applying circuit 31 and a positive polarity image signal is applied to the vertical signal lines H1*p* through H4*p* from the positive polarity image signal applying circuit 32. Thus, image signals with different polarities are written onto the pixel electrodes on any adjacently located two lines simultaneously. Additionally, a signal representing the logical product (AND) of the outputs G1, G2 of the vertical scanning circuit 30 and the polarity inversion signal INV is applied to the scanning lines S1*n*, S3*n*, whereas a signal representing the logical product (AND) of the outputs G1, G2 and a signal obtained by inverting the polarity inversion signal INV by means of inverter 25 is applied to the scanning lines S2*n*, S4*n*.

Now, referring to FIG. 3, signal INV is at level HIGH in the first field and S1*n*, S2*p*, S3*n* and S4*p* are sequentially selected during this period so that a negative polarity image signal is written onto the pixels on the odd lines, while a positive polarity image signal is written on the pixels on the even lines. Signal INV is at level LOW in the second field and S1*p*, S2*n*, S3*p* and S4*n* are sequentially selected during this period so that a positive polarity image signal is written onto the pixels on the odd lines, while a negative polarity image signal is written on the pixels on the even lines.

With this arrangement, it is now possible to drive the liquid crystal display apparatus, inverting the polarity on a line by line and field by field basis to display high quality images without using a large circuit to raise the power consumption rate.

[Third Embodiment]

Figure 4:
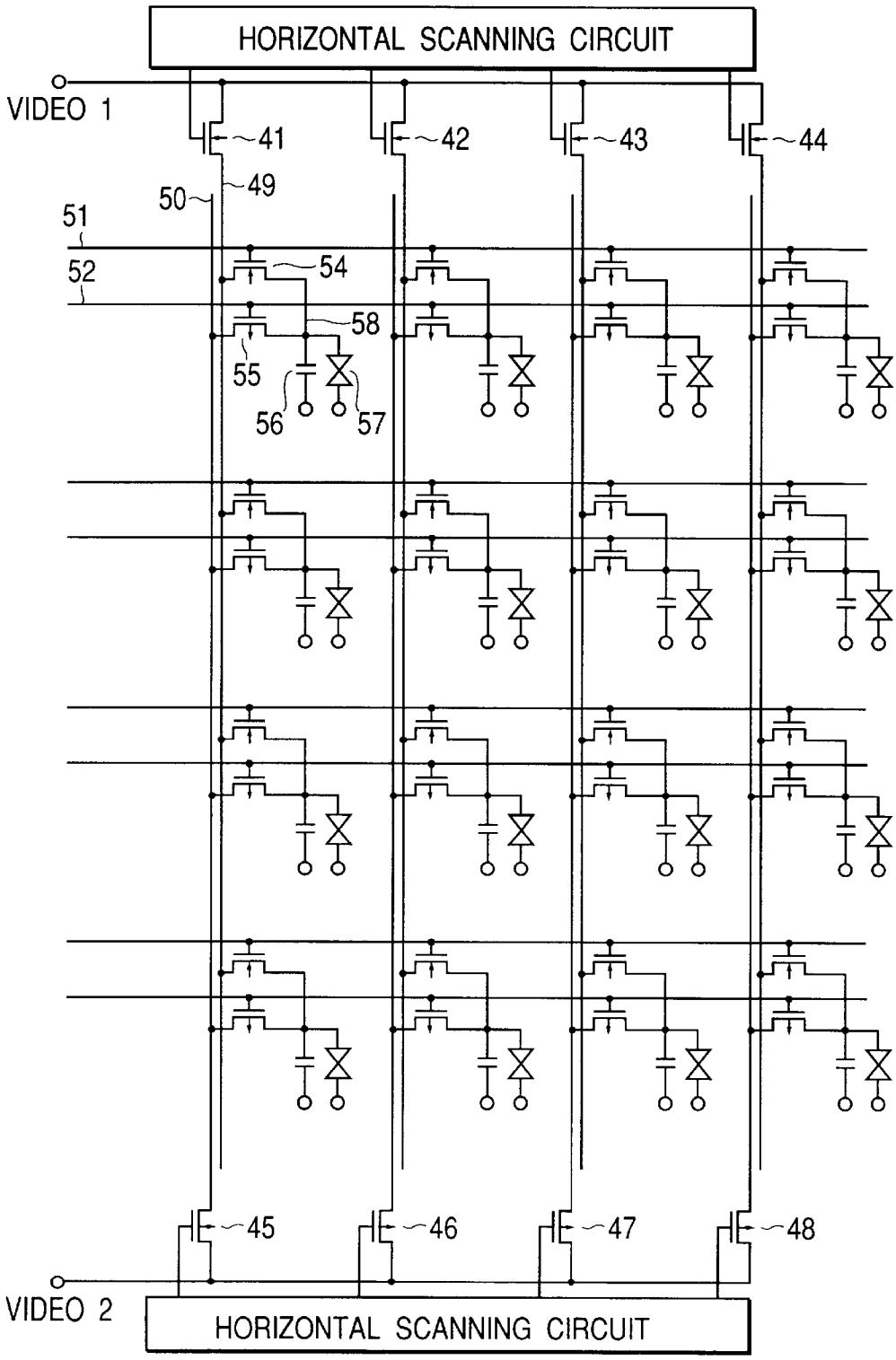
FIG. 4 is an equivalent circuit diagram of a third embodiment of the invention.

FIG. 4 is an equivalent circuit diagram of a third embodiment of the invention. In FIG. 4, reference numerals 41 through 48 denote signal transfer switches, of which signal transfer switches 41 through 44 respectively comprise n-channel type transistors while signal transfer switches 45 through 48 respectively comprise p-channel type transistors. Reference numerals 54 and 55 respectively denote n-channel type MOS transistors and p-channel type MOS transistors operating as pixel switches and reference numeral 56 denotes holding capacitances for holding the applied pixel signal, whereas reference numeral 57 denotes liquid crystal and reference numeral 58 denotes pixel electrodes for applying a voltage to the liquid crystal as a function of the pixel signals applied thereto.

In this embodiment, the signal transfer switches 41 through 44 for transferring image signals to vertical signal lines 49 to which the source electrodes (or the drain electrodes) of the n-channel type pixel transistors 54 are connected comprise only n-channel type transistors 41 through 44, whereas the signal transfer switches 45 through 48 for transferring image signals to vertical signal lines 50 to which the source electrodes (or the drain electrodes, whichever appropriate) of the p-channel type pixel transistors 55 are connected comprise only p-channel type transistors 45 through 48. In FIG. 4, reference symbol VIDEO1 denotes a negative polarity image signal and VIDEO2 denotes a positive polarity image signal. With this arrangement, the area occupied by the signal transfer switches 41 through 48 can be reduced without sacrificing the signal transfer capacity of the switches.

Figure 5:
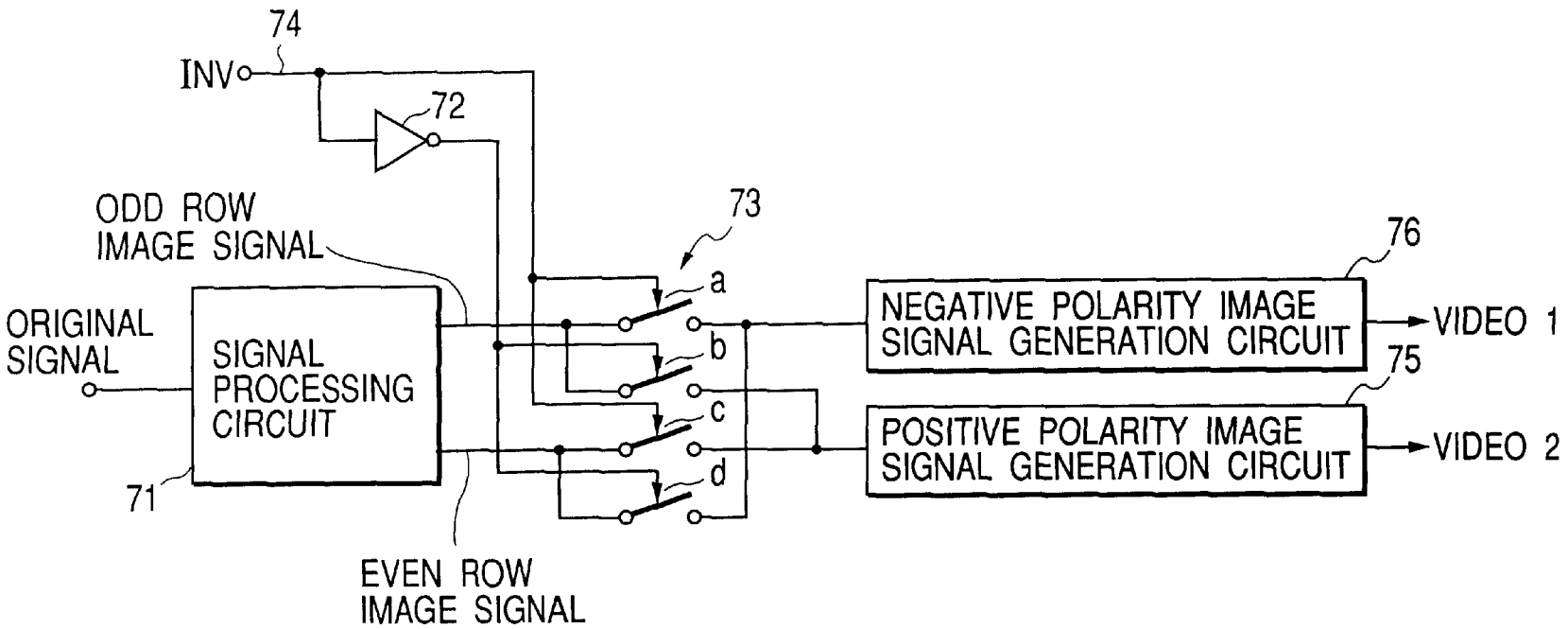
FIG. 5 is a schematic block diagram of a signal processing circuit that can be used for the purpose of the invention.
Figure 6:
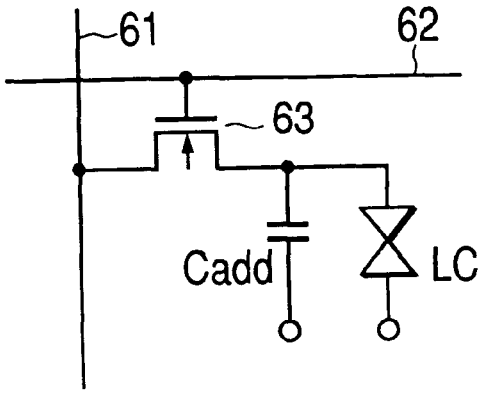
FIG. 6 is a schematic circuit diagram of a known liquid crystal drive switch.
Figure 8:
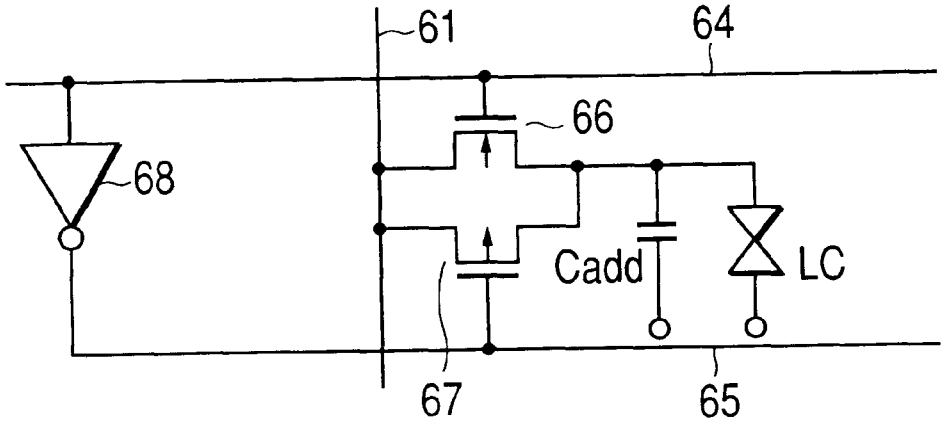
FIG. 8 is a schematic circuit diagram of another known liquid crystal drive switch.
Figure 7A:
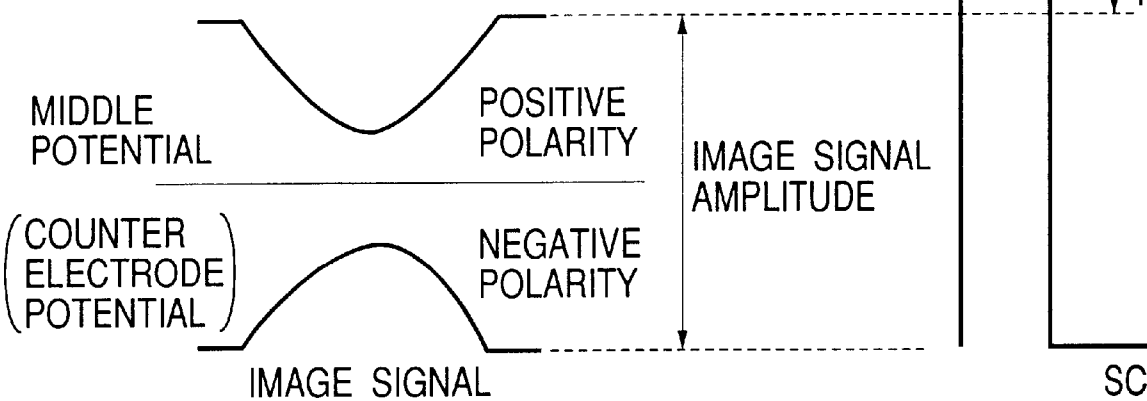
FIGS. 7A and 7B are graphic illustration of the operation of a known liquid crystal drive switch.
Figure 7B:
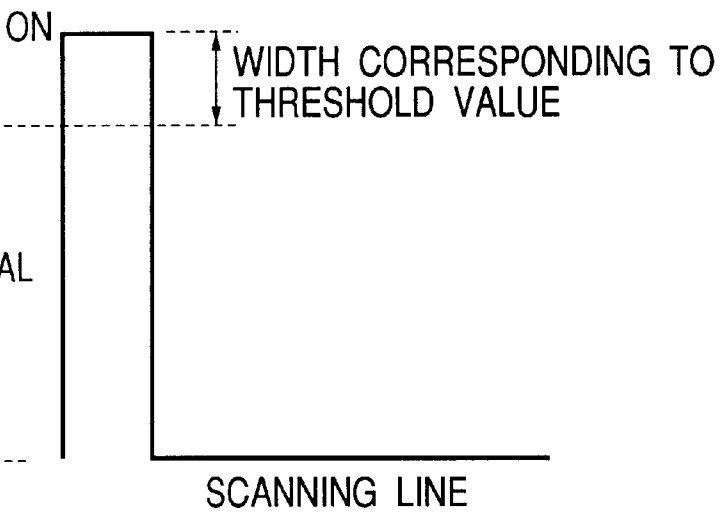
Figure 9A:
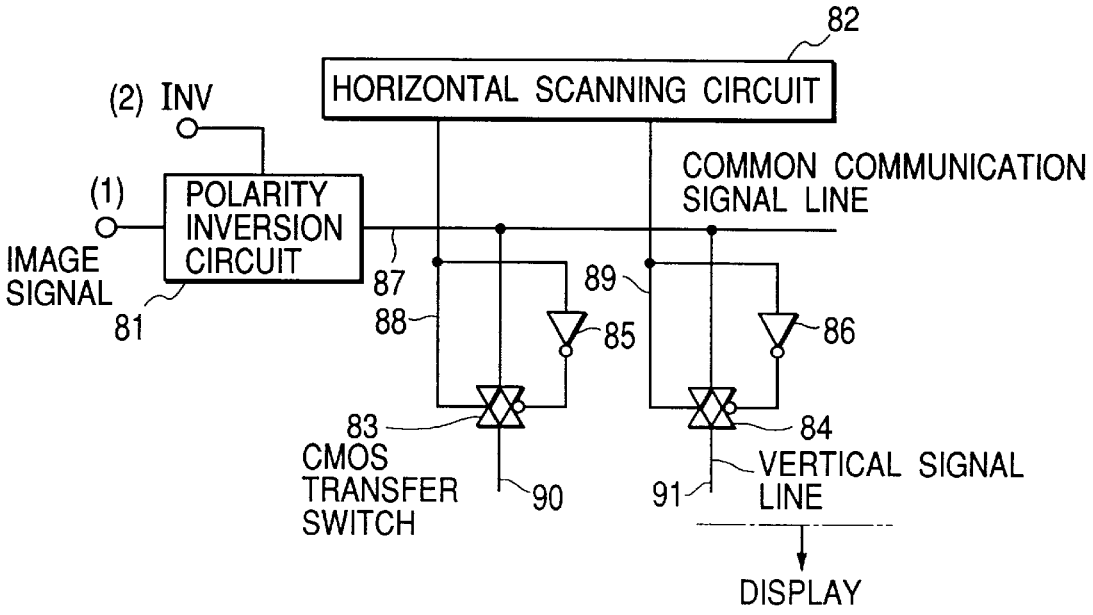
FIG. 9A is a schematic circuit diagram of still another known liquid crystal drive switch.
Figure 9B:
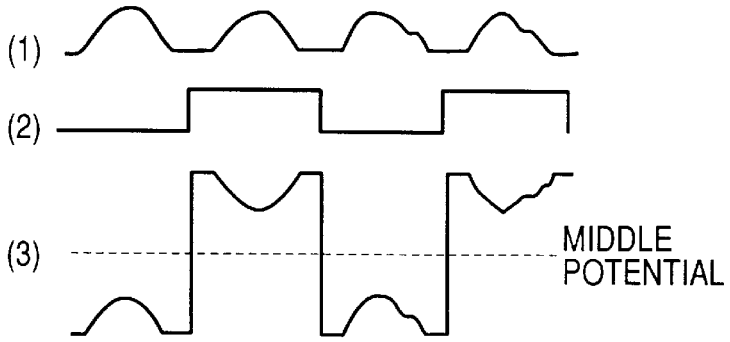
FIG. 9B is a graphic illustration of the operation of the known liquid crystal drive switch of FIG. 9A.

FIG. 5 is a schematic block diagram of a signal processing circuit that can be used for the purpose of the invention and adapted to generate positive and negative polarity image signals. Note that, with the circuit of FIG. 2, negative and positive polarity image signals have to be output sequentially for odd rows and even rows each time the polarity is inverted. However, with the circuit of FIG. 5, original signals are separated into those for odd rows and those for even rows by the signal processing circuit 71. If necessary, the signal processing circuit 71 performs other operations including interpolations for altering the resolution and Γ-corrections matching with the electro-optical characteristics of the liquid crystal. Then, the image signals for odd rows and those for even rows are transformed into signals of a level good for applying themselves to the liquid crystal by means of positive polarity image signal generating circuit 75 and negative polarity image signal generating circuit 76 by way of multiplexer 73. The multiplexer 73 can switch the destination of image signals for odd rows and those for even rows by means of polarity inversion signal INV and inverter 72.

With the above arrangement, image signals for odd rows can be switched to the positive polarity or to the negative polarity and, similarly, those for even rows can be switched to the negative polarity or to the positive polarity, whichever appropriate, each time the polarity is inverted so that images can be displayed by means of the circuit of FIG. 2 or FIG. 4. Thus, it is no longer necessary to provide the signal processing circuit 71 with a polarity inverting function to consequently simplify the circuit configuration.

[Fourth Embodiment]

Figure 10C:
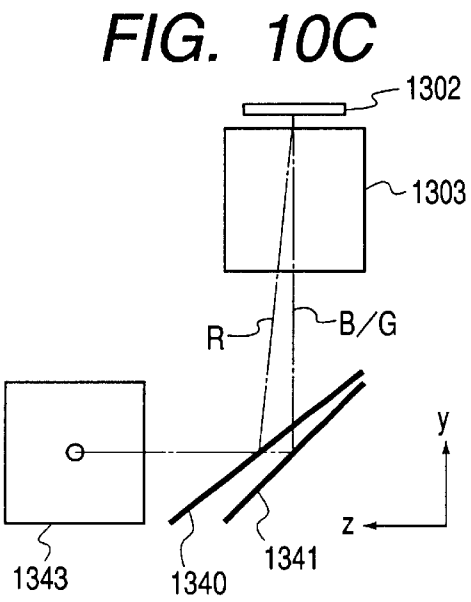
FIGS. 10A, 10B and 10C are schematic illustrations of an embodiment of the optical system of a projection type liquid crystal display apparatus according to the invention.
Figure 10A:
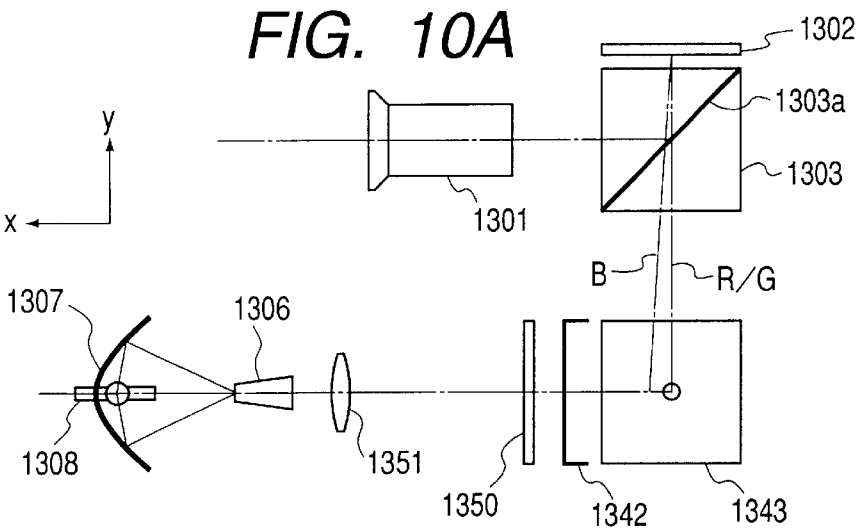
Figure 10B:
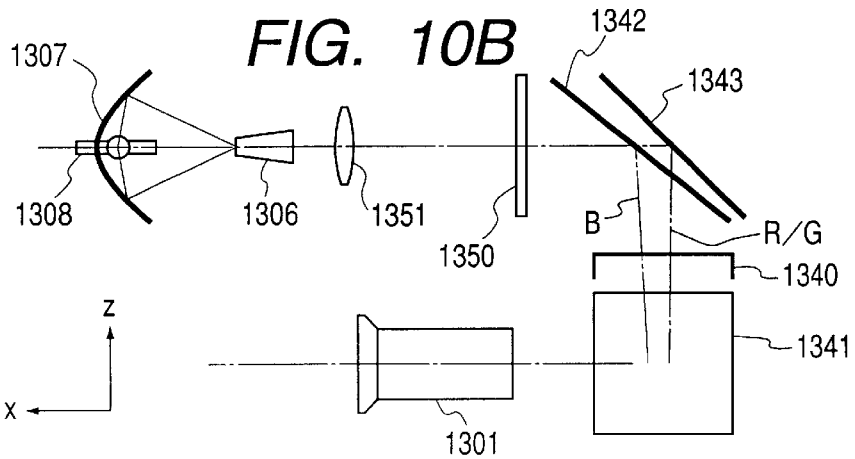

FIGS. 10A to 10C are-schematic illustrations of an embodiment of the optical system of a front and back projection type liquid crystal display apparatus comprising a liquid crystal display apparatus according to the invention. FIG. 10A shows a plan view, FIG. 10B shows a front view and FIG. 10C shows a side view. Referring to FIGS. 10A to 10C, there are shown a projection lens 1301 for projecting an image on the screen, a liquid crystal panel 1302 having a micro-lens, a polarization beam splitter (PBS) 1303, an R (red light) reflecting dichoric mirror 1340, a B/G (blue and green light) reflecting dichroic mirror reflecting dichroic mirror 1342, a white light reflecting high reflection mirror 1343, a Fresnel lens 1350, a convex lens 1351, a rod type integrator 1306, an elliptic reflector 1307, an arc lamp 1308 of, for example, metal halide or UHP.

Figure 11A:
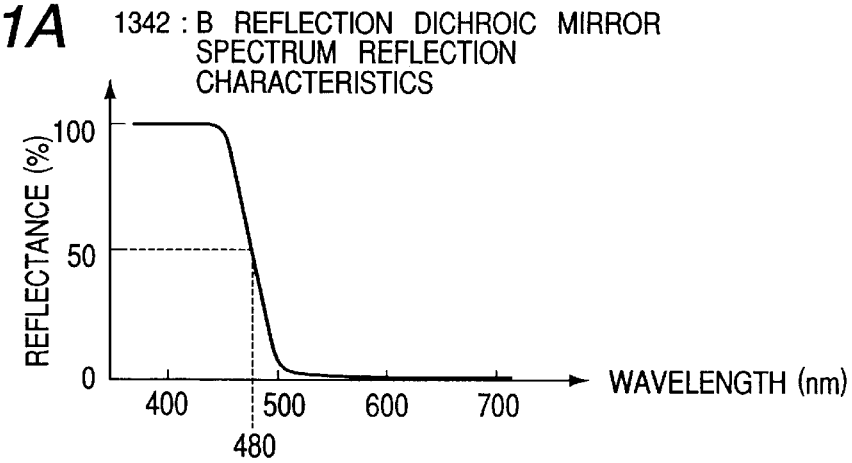
FIGS. 11A, 11B and 11C are graphs showing the spectral reflection characteristics of the reflective dichroic mirrors used for the optical system of a projection type liquid crystal display apparatus according to the invention.
Figure 11B:
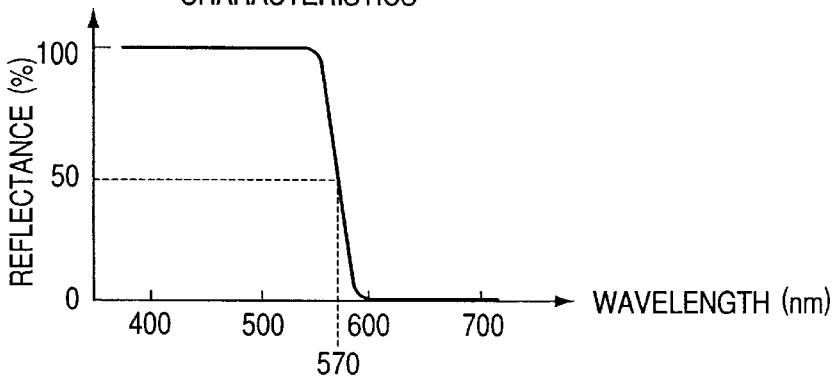
Figure 11C:
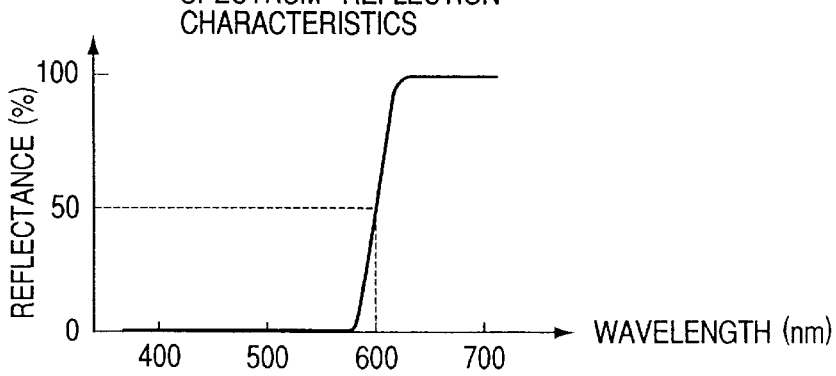
Figure 12:
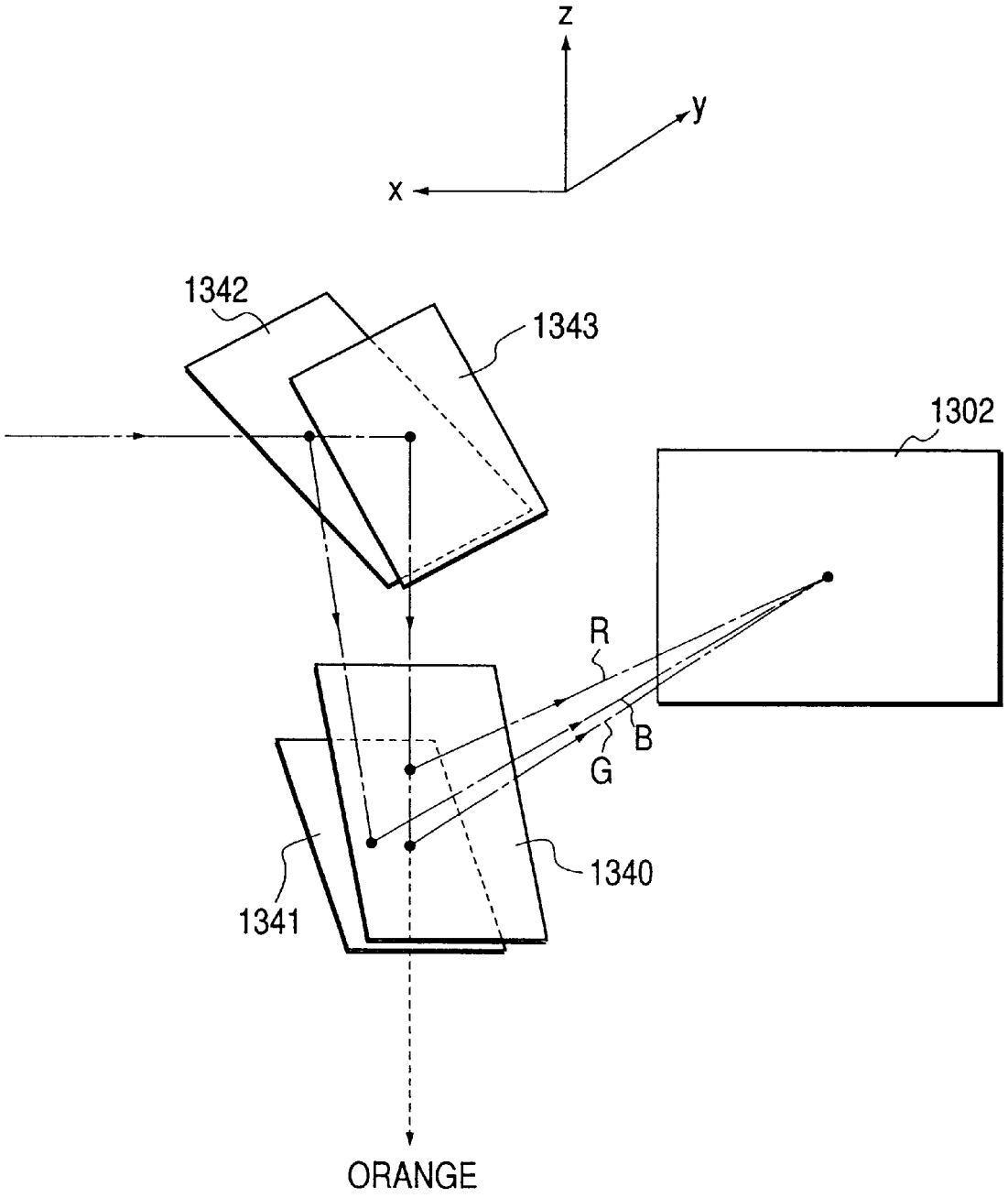
FIG. 12 is a schematic perspective view of the color separation/illumination section of the optical system of a projection type liquid crystal display apparatus according to the invention.

Note that the R (red light) reflecting dichroic mirror 1340, the B/G (blue and green light) reflecting dichroic mirror 1341 and the B (blue light) reflecting dichroic mirror 1342 have respective spectrum reflection characteristics illustrated in FIGS. 11A to 11C. The dichroic mirrors and the high reflection mirror 1343 are three-dimensionally arranged as shown in the perspective view of FIG. 12 to divide illuminated white light and separate R, G and B light as will be described hereinafter and cause rays of light of the three primary colors to irradiate the liquid crystal panel 1302 with respective angles that are three-dimensionally different from each other.

The operation of the optical system will be described in terms of the proceeding route of a flux of light. Firstly, the flux of light emitted from the lamp 1308 of the light source of the system is that of white light and converged by the elliptic reflector 1307 toward the inlet port of the integrator 1306 arranged in front of it. As the flux of light proceeds through the integrator 1306 with repeated reflections, the spatial intensity distribution of the flux of light is uniformized. After coming out of the integrator 1306, the flux of light is collimated along the x-direction (as shown in the front view of FIG. 10B) by the convex lens 1351 and the Fresnel lens 1350 before getting to the B reflecting dichroic mirror 1342. Only B light (blue light) is reflected by the B reflecting dichroic mirror 1342 and directed to the R reflecting dichroic mirror 1340 along the z-axis or downwardly in FIG. 10B, showing a predetermined angle relative to the z-axis.

Meanwhile, light than B light (R/G light) passes through the B reflecting dichroic mirror 1342 and reflected rectangularly by the high reflection mirror 1343 into the direction of the z-axis (downwardly) and also directed to the R reflecting dichroic mirror 1340. Referring to the front view of FIG. 10A, both the B reflecting dichroic mirror 1342 and the high reflection mirror 1343 are arranged to reflect the flux of light coming from the integrator 1306 (along the direction of the x-axis) into the direction of the z-axis (downwardly), the high reflection mirror 1343 being tilted around the axis of rotation, or the y-axis, exactly by 45° relative to the x-y plane. On the other hand, the B reflecting dichroic mirror 1342 is tilted around the axis of rotation, or the y-axis, by an angle less than 45° relative to the x-y plane.

Thus, while R/G light reflected by the high reflection mirror 1343 is directed rectangularly toward the z-axis, B light reflected by the B reflecting dichroic mirror 1342 is directed downwardly, showing a predetermined angle relative to the z-axis (tilted in the x-z plane). Note that the extent of shifting the high reflection mirror 1343 and the B reflecting dichroic mirror 1342 relative to each other and the angle of tilt of the B reflecting dichroic mirror will be so selected that the principal beams of light of the three primary colors intersect each other on the liquid crystal panel 1302 in order to make B light and R/B light show an identical coverage on the liquid crystal panel 1302.

The downwardly directed fluxes of R/G/B light (along the z-axis) then proceeds to the R reflecting dichroic mirror 1340 and the B/G reflecting dichroic mirror 1341, which are located below the B reflecting dichroic mirror 1342 and the high reflection mirror 1343. The B/G reflecting dichroic mirror 1341 is tilted around the axis of rotation, or the x-axis by 450 relative to the x-z plane, whereas the R reflecting dichroic mirror 1340 is tilted around the axis of rotation, or the x-axis, by an angle less than 45° relative to the x-z plane. Thus, of the incoming fluxes of R/G/B light, those of B/G light firstly pass through the R reflecting dichroic mirror 1340 and reflected rectangularly into the positive direction of the y-axis by the B/G reflecting dichroic mirror 1341 into the positive direction of the y-axis before they are polarized by way of PBS 1303 and illuminate the liquid crystal panel 1302 arranged horizontally on the x-z plane. Of the fluxes of B/G light, that of B light shows a predetermined angle relative to the x-axis (tilted in the x-z plane) as described above (see FIGS. 10A and 10B) so that, after having been reflected by the B/G reflecting dichroic mirror 1341, it maintains the predetermined angle relative to the y-axis (tilted in the x-y plane) and illuminates the liquid crystal panel 1302 with an angle of incidence equal to the predetermined angle (relative to the x-y plane).

On the other hand, the flux of G light is reflected rectangularly by the B/G reflecting dichroic mirror 1341 and proceeds into the positive direction of the y-axis before it is polarized and hits the liquid crystal panel 1302 perpendicularly with an angle of incidence of 0°. The flux of R light is reflected by the R reflecting dichroic mirror 1340 which is arranged upstream relative to the B/G reflecting dichroic mirror 1341 as pointed out above into the positive direction of the y-axis and proceeds along the positive direction of the y-axis, showing a predetermined angle relative to the y-axis (titled in the y-z plane) as shown by FIG. 10C (lateral view) before it is polarized by way of the PBS 1303 and hits the liquid crystal panel 1302 with an angle incidence equal to the predetermined angle (relative to the y-z plane). As pointed out above, the extent of shifting the B/G reflecting dichroic mirror 1341 and the R reflecting dichroic mirror 1340 relative to each other and the angle of tilt of the R reflecting dichroic mirror will be so selected that the principal beams of light of the three primary colors intersect each other on the liquid crystal panel 1302 in order to make the fluxes of R/G/B light show an identical coverage on the liquid crystal panel 1302.

The cutting frequency of the B reflecting dichroic mirror 1342 is 480 nm as shown by FIG. 11A and that of the B/G reflecting dichroic mirror 1341 is 570 nm as shown by FIG. 11B, whereas that of the R reflecting dichroic mirror 1340 is 600 nm as shown by FIG. 11C. Thus, unnecessary orange light is discarded after passing through the B/G reflecting dichroic mirror 1341 to realize an optimal color balance.

As described in greater detail hereinafter, rays of R/G/B light are reflected and polarized for modulation by the liquid crystal panel 1302 and return to the PBS 1303, where the fluxes reflected into the positive direction of the x-axis by the PBS plane 1303*a* of the PBS 1303 are used as light for producing enlarged and projected images on the screen (not shown) by way of the projection lens 1301. Since the fluxes of R/G/B light striking the liquid crystal panel 1302 have respective angles of incidence that are different from each other, the fluxes of light reflected by it and coming out therefrom shows respective angles that are also different from each other. However, the projection lens 1301 has a lens diameter and an aperture that are large enough for accommodating the differences. Note that the fluxes of light striking the projection lens 1301 are collimated as they pass through the micro-lens array twice per each to maintain a predetermined angle for striking the liquid crystal panel 1302.

Figure 18:
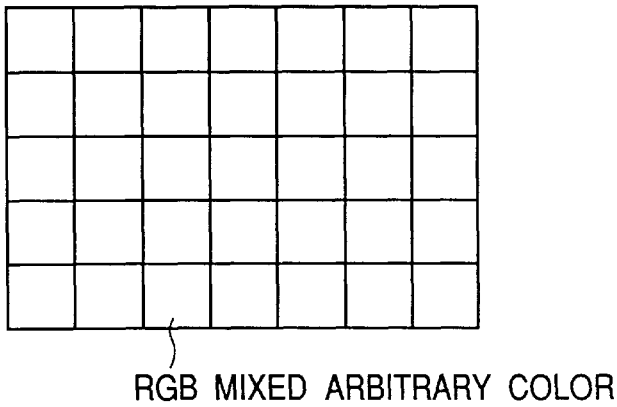
FIG. 18 is an enlarged partial plan view of an image projected on the display screen of a projection type liquid crystal display apparatus according to the invention.
Figures 22, 23:
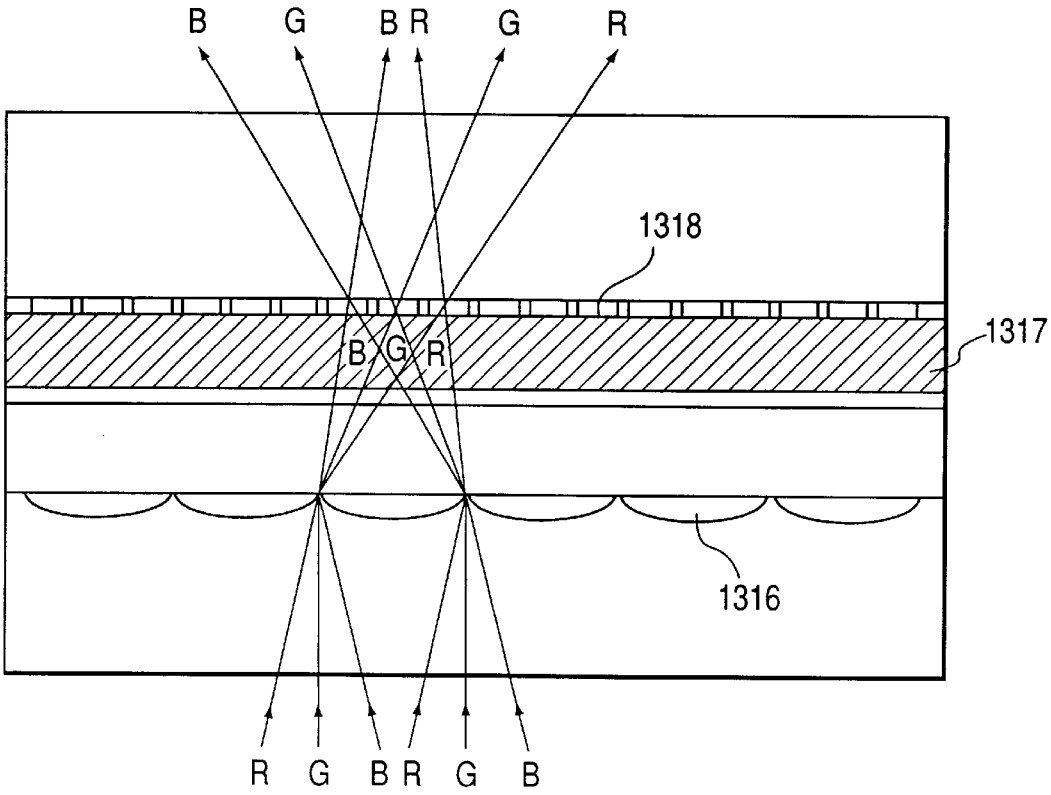
FIG. 22 is a schematic illustration of the liquid crystal panel of a liquid crystal apparatus, showing how fluxes of light proceed.
FIG. 23 is a schematic illustration of the arrangement of color pixels of the liquid crystal panel of a liquid crystal apparatus.

With a known transmission type liquid crystal display apparatus as shown in FIG. 18, on the other hand, the flux of light exiting the liquid crystal panel is diametrically significantly enlarged partly due to the converging effect of the micro-lens array so that the projection lens for catching the flux is required to have a greater numerical aperture, making the projection lens costly. On the other hand, with this embodiment, the expansion of the flux of light coming from the liquid crystal panel 2 is relatively limited so that a sufficiently bright image can be projected on the screen by using a projection lens having a relatively small numerical aperture. While a stripe type display mode using vertically long stripes of same colors as shown in FIG. 23 may be used for this embodiment, such a mode of display is not preferable for a liquid crystal panel using a micro-lens array as will be described hereinafter.

Now, the liquid crystal panel 1302 of this embodiment will be described. FIG. 18 is an enlarged schematic cross sectional view of the liquid crystal panel 1302 (taken along the y-z plane of FIG. 12). Referring to FIG. 18, there are shown a micro-lens substrate 1321, a number of micro-lenses 1322, a sheet glass 1323, a transparent opposite electrode 1324, a liquid crystal layer 1325, a number of pixel electrodes 1326, an active matrix drive circuit 1327 and a silicon semiconductor substrate 1328. Reference numeral 1352 denotes a peripheral seal section. In this embodiment, R, G and B pixels are intensively arranged on a single panel so that each single pixel inevitably has reduced dimensions. Thus, it is important that the panel shows a large aperture ratio and a reflection electrode should be found within the area covered by converged light so that the use of any of the arrangements of the first through fifth embodiments is significant for this embodiment. The micro-lenses 1322 are formed on the surface of a glass substrate (alkali glass) 1321 by means of a so-called ion-exchange technique and arranged in two-dimensional array at a pitch twice as high as that of the pixel electrodes 1326.

ECB (electrically controlled birefringence) mode nematic liquid crystal such as DAP (deformation of aligned phase) or HAN (hybrid aligned nematic) that is adapted to a reflection type display is used for the liquid crystal layer 1325 and a predetermined orientation is maintained by means of an orientation layer (not shown). It will be appreciated that the circuit configuration and other arrangement of this invention is highly effective particularly for this embodiment because the accuracy of the potential of the pixel electrodes 1326 is highly important. Additionally, the flexibility of wiring arrangement and the density of wires can be enhanced when the wiring angle between 30° and 60° is preferably selected for the metal wires because a large number of pixels are arranged on a single panel in this embodiment. The pixel electrodes 1326 are made of aluminum and operate as reflector. Therefore, they are processed by a so-called CMP treatment technique after the patterning operation in order to improve the smoothness and the reflectivity of the surface (as will be described in greater detail hereinafter).

The active matrix drive circuit 1327 is a semiconductor circuit arranged on the silicon semiconductor substrate 1328 to drive the pixel electrodes 1326 in an active matrix drive mode. Thus, gate line drivers (vertical registers, etc.) and signal line drivers (horizontal registers, etc.) (not shown) are arranged in the peripheral area of the circuit matrix (as will be discussed in detail hereinafter). The peripheral drivers and the active matrix drive circuit are so arranged as to write primary color video signals of RGB on the respective RGB pixels in a predetermined fashion. Although the pixel electrodes 1326 are not provided with color filters, they are identified respectively as RGB pixels by the primary color image signals to be written onto them by the active matrix drive circuit as they are arranged in array.

Take, for example, rays of G light that illuminate the liquid crystal panel 1302. As described above, G light is polarized by the PBS 1303 and then perpendicularly strikes the liquid crystal panel 1302. FIG. 18 shows a beam of G light that enters the micro-lens 1322*a* in a manner as indicated by arrow G (in/out). As shown, the beam of G light is converged by the micro-lens 1322 to illuminate the surface of the G pixel electrode 1326*g* before it is reflected by the aluminum-made pixel electrode 1326G and goes out of the panel through the same micro-lens 1322*a*. As the beam of G light (polarized light) moves through the liquid crystal layer 1325, it is modulated by the electric field generated between the pixel electrode 1326*g* and the opposite electrode 1324 by the signal voltage applied to the pixel electrode 1326*g* before it returns to the PBS 1303.

Thus, the quantity of light reflected by the PBS plane 1303*a* and directed to the projection lens 1301 changes depending on the extent of modulation to define the gradation of the related pixel. On the other hand, R light enters the cross sectional plane (the y-z plane) of FIG. 13 slantly in a manner as described above after having been polarized by the PBS 1303. Take, now, a beam of R light striking the micro-lens 1322*b*. It is converged by the micro-lens 1322*b* in a manner as indicated by arrow R (in) in FIG. 18 to illuminate the surface of the R pixel electrode 1326*r* located at a position shifted to the left in FIG. 13 from the spot right below it before it is reflected by the pixel electrode 1326*r* and goes out of the panel through the adjacently located micro-lens 1322*a* (in the negative direction of the z-axis) (R(out)).

As in the case of G light described above, as the beam of R light (polarized light) moves through the liquid crystal layer, it is modulated by the electric field generated between the pixel electrode 1326*r* and the opposite electrode 1324 by the signal voltage applied to the pixel electrode 1326*r* before it goes out of the liquid crystal panel and returns to the PBS 1303. Then, as described above in terms of G light, light from the pixel is projected through the projection lens 1301. While the beams of G light and R light on the pixel electrodes 1326*g* and 1326*r* may appear overlapping and interfering with each other in FIG. 19, it is because the liquid crystal layer is shown excessively thick, although it has a thickness between 1 and 5 $\mu$m in reality, which is very small if compared with the sheet glass 1323 having a thickness between 50 and 100 $\mu$m so that no such interference actually takes place regardless of the size of each pixel.

Figure 13:
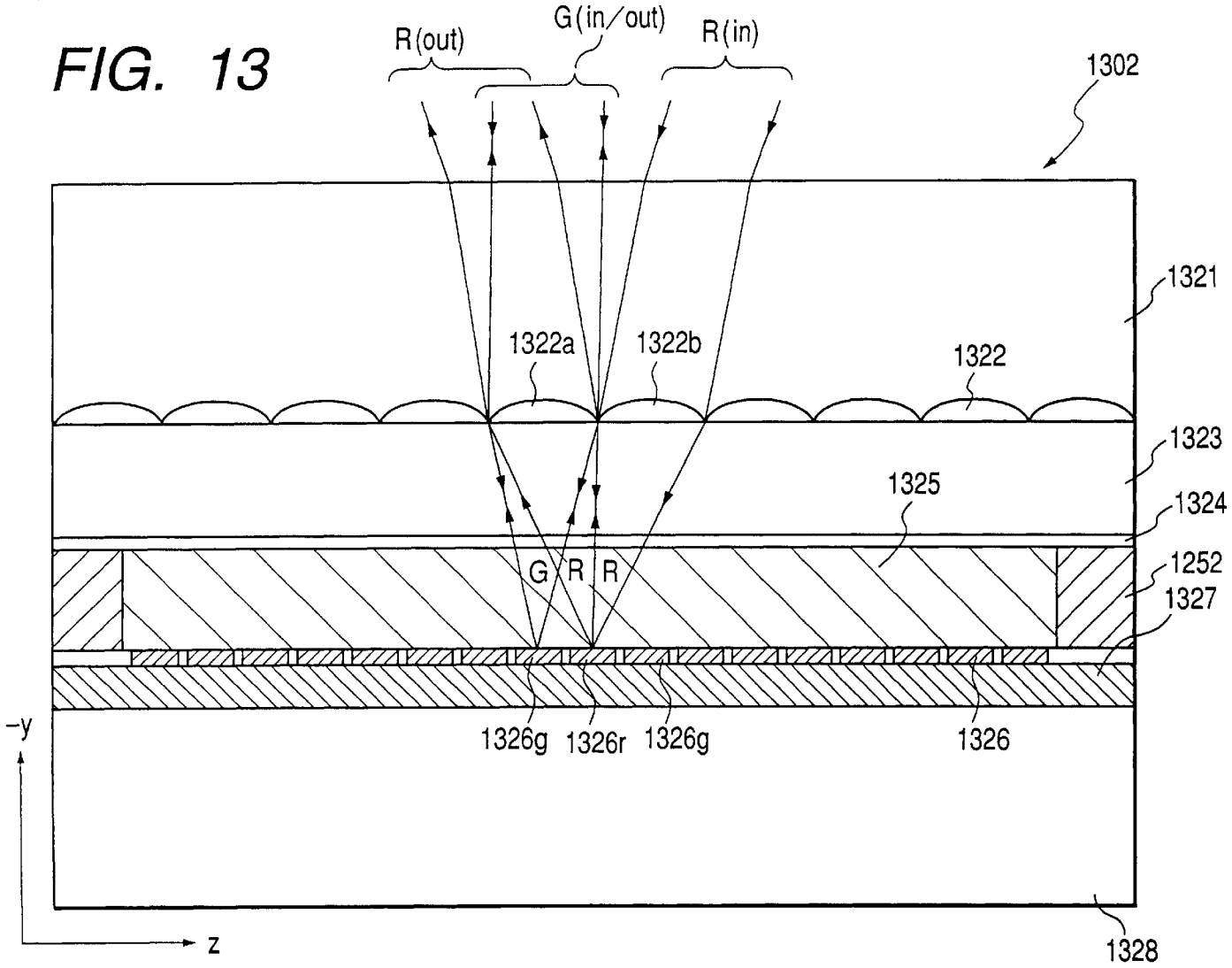
FIG. 13 is a schematic cross sectional view of an embodiment of liquid crystal panel according to the invention.
Figure 14A:
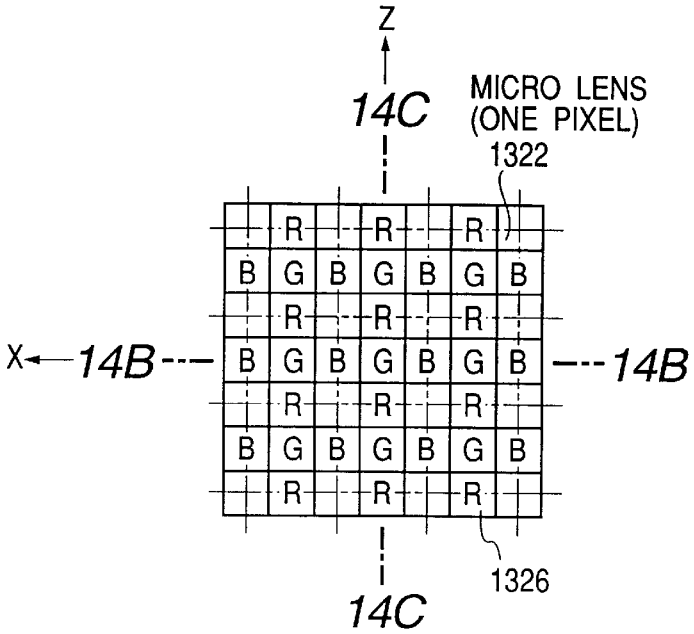
FIGS. 14A, 14B and 14C are schematic illustrations of the principle of color separation and color synthesis, underlying a liquid crystal panel according to the invention.
Figure 14C:
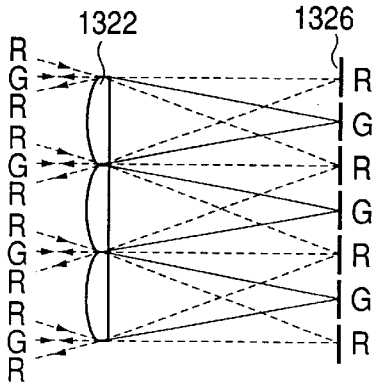
Figure 14B:
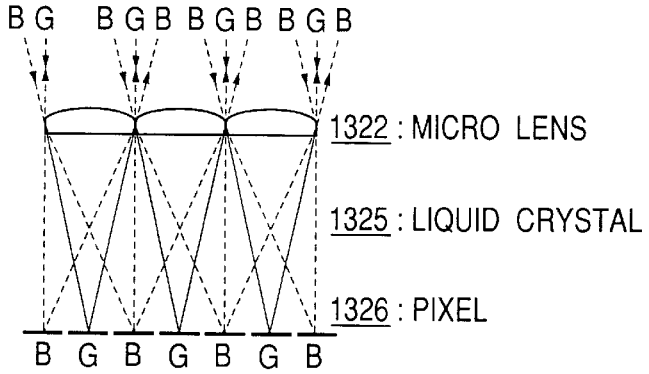

FIGS. 14A to 14C are schematic illustrations of the principle of color separation and color synthesis, underlying the liquid crystal panel 1302 of this embodiment. FIG. 14A is a schematic plan view of the liquid crystal panel, whereas FIGS. 14B and 14C respectively show schematic cross sectional views taken along line 14B—14B (along the x-direction) and line 14C—14C (along the z-direction) of FIG. 14A. As indicated by dotted broken lines in FIG. 14A, each micro-lens 1322 corresponds to a half of a set of two-color pixels adjacently located with a G light pixel arranged at the center. Note that FIG. 14C corresponds to the cross sectional view of FIG. 13 taken along the y-z plane and shows how beams of G light and R light enter and go out from the respective micro-lenses 1322. As seen, each G pixel electrode is located right below a corresponding micro-lens and each R pixel electrode is located right below the boundary line of corresponding two adjacent micro-lenses. Therefore, the angle of incidence θ of R light is preferably so selected that tan θ is equal to the ratio of the pitch of pixel arrangement (B and R pixels) to the distance between the micro-lenses and the pixel electrode.

On the other hand, FIG. 14B correspond to a cross section of the liquid crystal panel 1302 taken along the x-y plane. As for the cross section along the x-y plane, it will be understood that B pixel electrodes and G pixel electrodes are arranged alternately as shown in FIG. 14C and each G pixel electrode is located right below a corresponding micro-lens whereas each B pixel electrode is located right below the boundary line of corresponding two adjacent micro-lenses.

B light for irradiating the liquid crystal panel enters the latter slantly as viewed from the cross section (the x-y plane) of FIGS. 10A to 10C after having been polarized by the PBS 1303 as described above. Thus, just like R light, each beam of B light entering from a corresponding micro-lens 1322 is reflected by a corresponding B pixel electrode 1326*b* as shown and goes out of the panel through the adjacently located micro-lens 1322 in the x-direction. The mode of modulation by the liquid crystal on the B pixel electrodes 1326*b* and that of projection of B light coming out of the liquid crystal panel are same as those described above by referring to G light and R light.

Each B pixel electrode 1326 is located right below the boundary line of corresponding two adjacent micro-lenses. Therefore, the angle of incidence θ of B light is preferably so selected that tan θ is equal to the ratio of the pitch of pixel arrangement (G and B pixels) to the distance between the micro-lenses and the pixel electrode. The pixels of the liquid crystal panel of this embodiment are arranged RGRGRG . . . in the z-direction and BGBGBG . . . in the x-direction. In FIGS. 14A to 14C, FIG. 14A shows the pixel arrangement as viewed from above. As seen, each pixel has a size equal to a half of a micro-lens for both longitudinally and transversally so that the pixels are arranged at a pitch twice as high as the micro-lenses. As viewed from above, each G pixel is located right below a corresponding micro-lens, while each R pixel is located right below the boundary line of corresponding two adjacent micro-lenses in the z-direction and each B pixel is located right below the boundary line of corresponding two adjacent micro-lenses in the x-direction. Each micro-lens has a rectangular contour (and is twice as large as a pixel).

Figure 15:
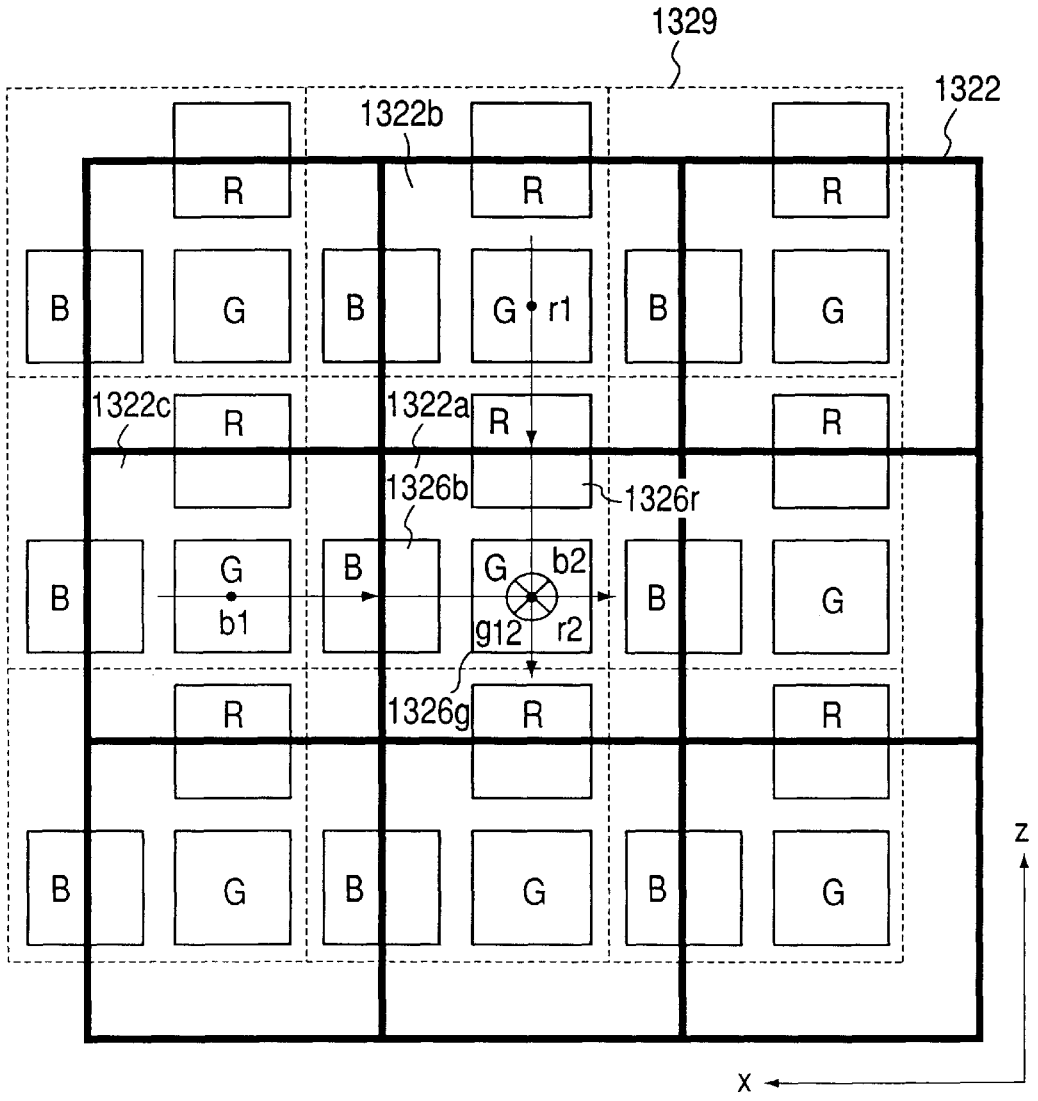
FIG. 15 is an enlarged partial plan view of the first embodiment of liquid crystal panel according to the invention.

FIG. 15 is an enlarged partial plan view of the liquid crystal panel of this embodiment. Each square 1329 defined by broken lines indicates a unit of RGB pixels. In other words, when the RGB pixels of the liquid crystal panel are driven by the active matrix drive circuit section 1327 of FIG. 13, the unit of RGB pixels in each broken line square 1329 is driven by corresponding RGB picture signals.

Now, take the picture unit of R pixel electrode 1326*r*, G pixel electrode 1326*g* and B pixel electrode 1326*b*. The R pixel electrode 1326*r* is illuminated by R light coming from the micro-lens 1322*b* and striking the pixel electrode aslant as indicated by arrow r1 and reflected R light goes out through the micro-lens 1322*a* as indicated by arrow r2. The B pixel electrode 1326*b* is illuminated by B light coming from the micro-lens 1322*c* and striking the pixel electrode aslant as indicated by arrow b1 and reflected B light goes out through the micro-lens 1326*a* as indicated by arrow b2. Finally, the G pixel electrode 1326*g* is illuminated by G light coming from the micro-lens 1322*a* and striking the pixel electrode perpendicularly (downwardly in FIG. 15) as indicated by arrow g12 showing only the back and reflected G light goes out through the same micro-lens 1322*a* perpendicularly (upwardly in FIG. 15).

Thus, while the beams of light of the three primary colors striking the picture unit of RGB pixels enters through different micro-lenses, they go out through a same micro-lens (1322*a*). The above description applies to all the picture unit (of RGB pixels) of the embodiment.

Figure 16:
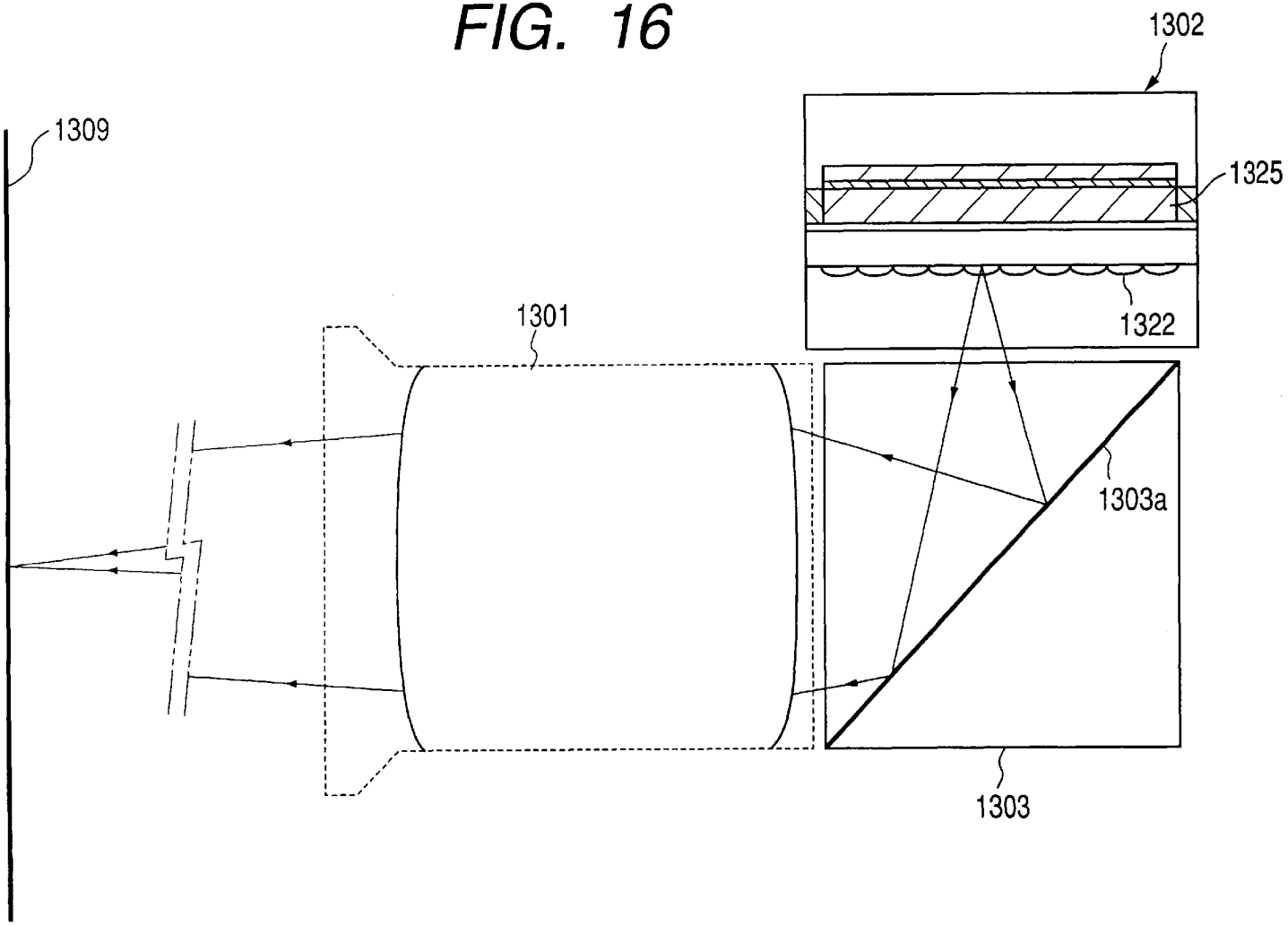
FIG. 16 is a schematic illustration of part of the projection optical system of a projection type liquid crystal display apparatus according to the invention.

Therefore, when light emitted from the liquid crystal panel of this embodiment is projected onto the screen 1309 by way of the PBS 1303 and the projection lens 1301 in such a way that a focused image of the micro-lenses 1322 of the liquid crystal panel 1302 is projected on the screen by regulating the optical system as shown in FIG. 16, the projected image will show the picture units of RGB pixels for the corresponding respective micro-lenses as perfect white light obtained by mixing the beams of light of the three primary colors. The net result will be the display of high quality color images free from the mosaic of RGB as shown in FIG. 23 for a conventional liquid crystal panel.

As the active matrix drive circuit 1327 is located under the pixel electrodes 1326 as shown in FIG. 13, the drain of each pixel FET is connected to the corresponding one of the RGB pixel electrodes arranged two-dimensionally as shown in FIG. 15.

Figure 17:
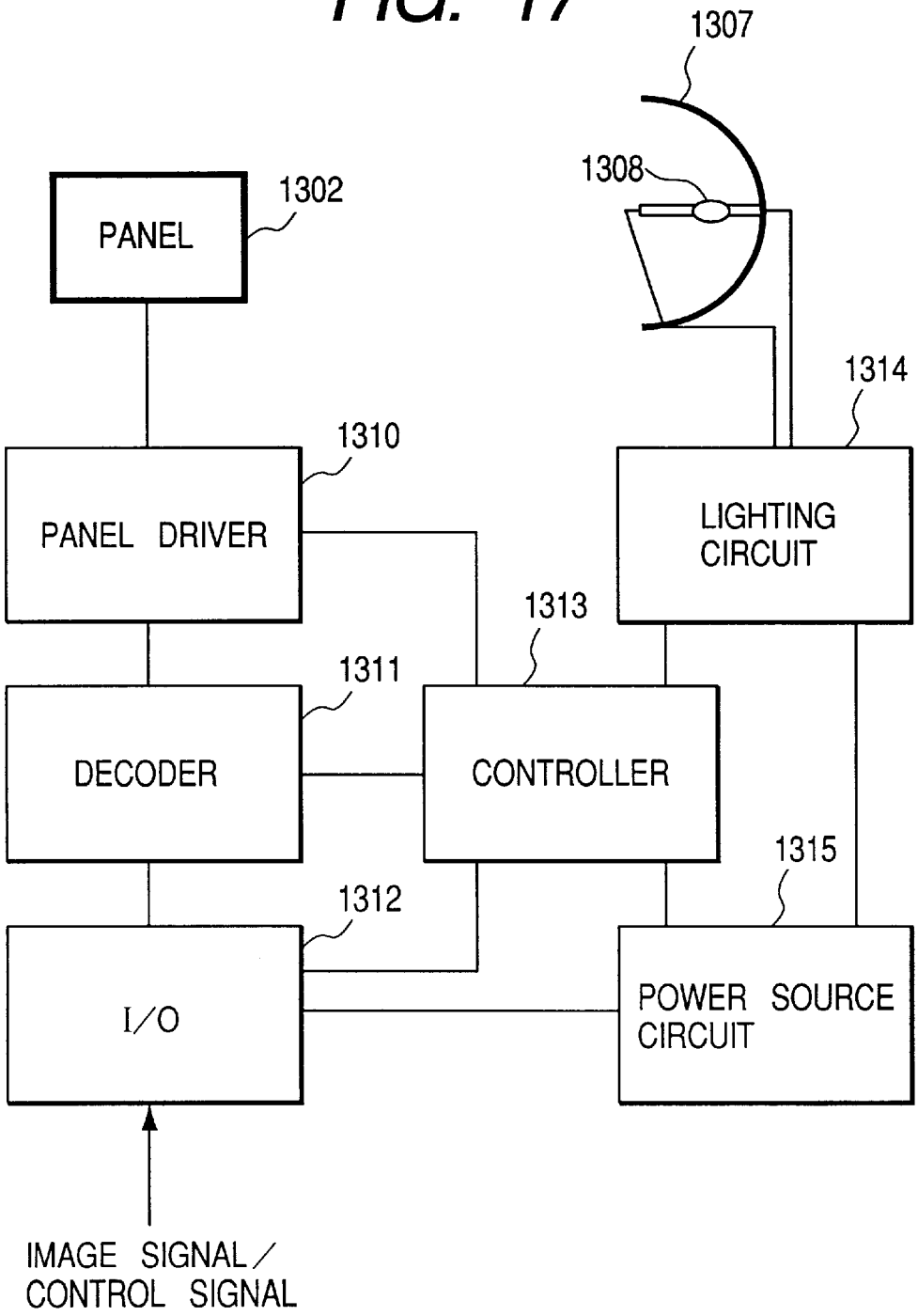
FIG. 17 is a schematic block diagram of the drive circuit of a projection type liquid crystal display apparatus according to the invention.

FIG. 17 is a schematic block diagram of the drive circuit of a projection type liquid crystal display apparatus comprising the above described liquid crystal display apparatus. Reference numeral 1310 denotes a panel driver for producing liquid crystal drive signals with a voltage amplified in a predetermined fashion and also drive signals for the opposite electrode 1324 and various timing signals. Furthermore, the circuit can be dimensionally reduced to lower the power consumption rate by using any of the circuit configurations of arranging liquid crystal drive switches, vertical signal lines and scanning lines as described by referring to the above embodiments. Reference numeral 1312 denotes an interface for decoding various picture signals and control transmission signals into standard picture signals and standard control signals respectively. Reference numeral 1311 denotes a decoder for decoding/transforming the standard picture signals from the interface 1312 into picture signals for the RBG primary colors and synchronizing signals, or video signals adapted to the liquid crystal panel 1302. Reference numeral 1314 denotes a lighting circuit operating as ballast for driving and lighting the arc lamp 1308 in the elliptic reflector 1307. Reference numeral 1315 denotes a power supply circuit for feeding the circuit blocks with power.

Reference numeral 1313 denotes a controller containing a control panel (not shown) for comprehensively controlling the circuit blocks and give instructions to the panel driver 1310, above all, on polarity inversion, on the number of fields every which the operation is to be switched for adjustment and on the color to be selected for adjustment. Thus, it will be seen that a projection type liquid crystal display apparatus according to the invention comprises a drive circuit that controls the operation of irradiating the liquid crystal panel 1302 with white light emitted from an arc lamp 1308, which may be a metal halide lamp operating as single panel projector, and projecting the light reflected from the reflection type liquid crystal panel 1302 onto the screen as video signals by way of a lens system (not shown) in order to display enlarged images. Then, the apparatus can display high quality color images by driving the liquid crystal panel, while minimizing the sticking phenomenon.

Figure 19:
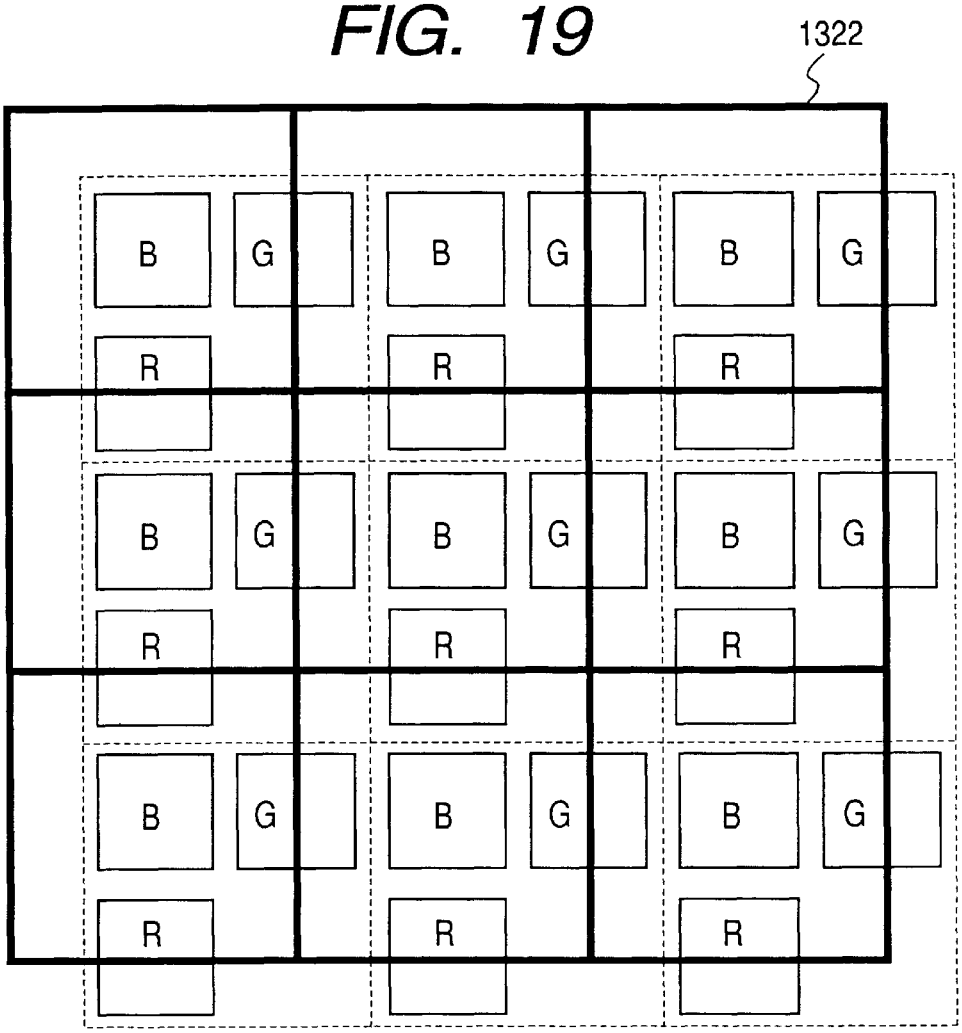
FIG. 19 is an enlarged partial plan view of another embodiment of liquid crystal panel according to the invention.

FIG. 19 is an enlarged partial plan view of another liquid crystal panel that can be used for this embodiment. In this panel, each B pixel electrode 1326*b* is arranged right below a corresponding micro-lens 1322 and sided transversally by a pair of G pixel electrodes 1326*g* and longitudinally by a pair of R pixel electrodes 1326*r*. With this arrangement, the panel operates exactly same as the above described panel as B light is made to strike it perpendicularly while R/G light is made to enter it slantly (with a same angle of incidence but in different directions) so that the beams of reflected light of the three primary colors come out of the respective RGB pixel electrodes of the corresponding picture unit through a common micro-lens. Alternatively, each R pixel electrode may be arranged right below a corresponding micro-lens 1322 and sided by a pair of G pixel electrodes and a pair of B pixel electrodes.

[Fifth Embodiment]

Figure 20:
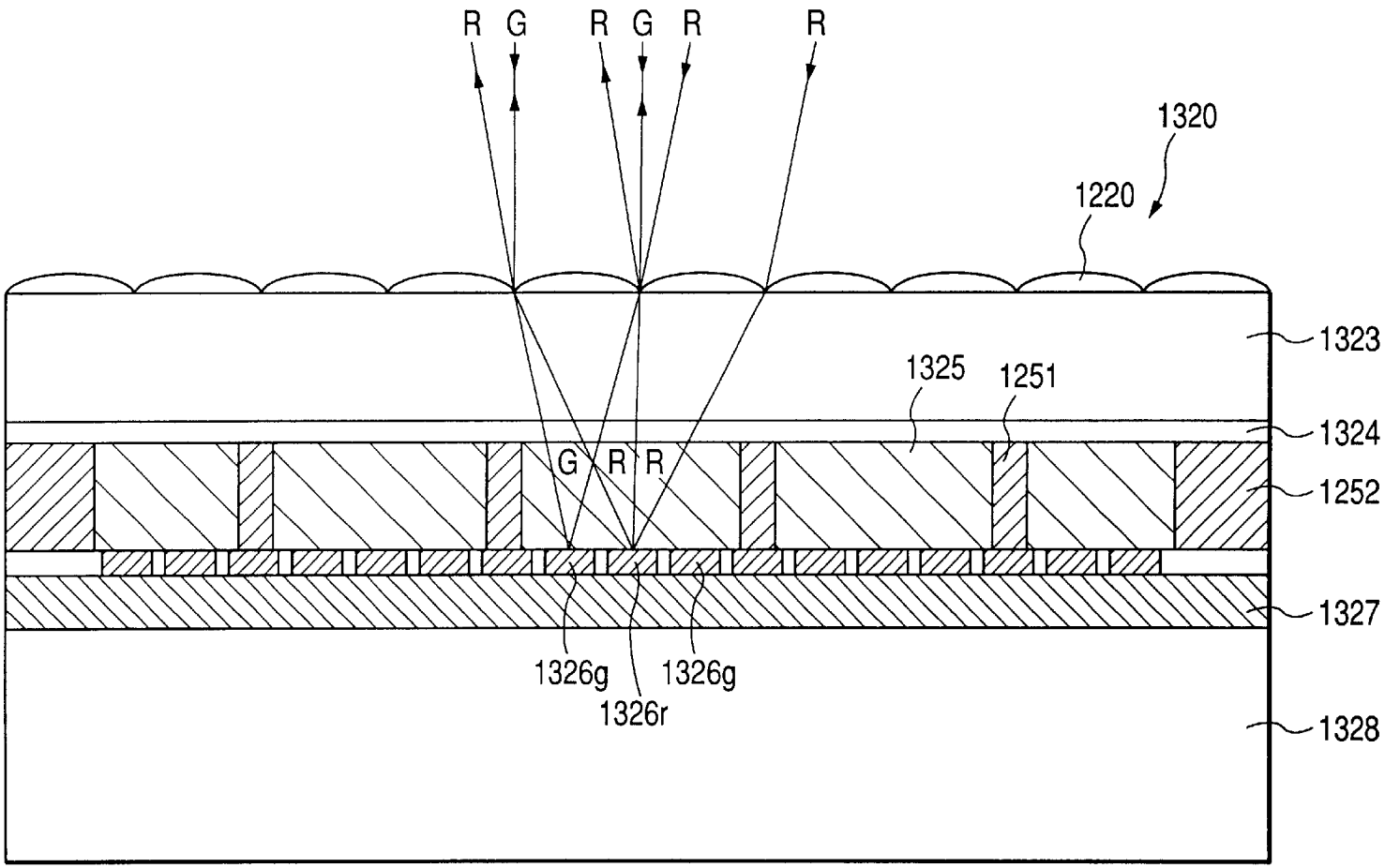
FIG. 20 is a schematic cross sectional view of the embodiment of liquid crystal panel of FIG. 19.
Figure 21A:
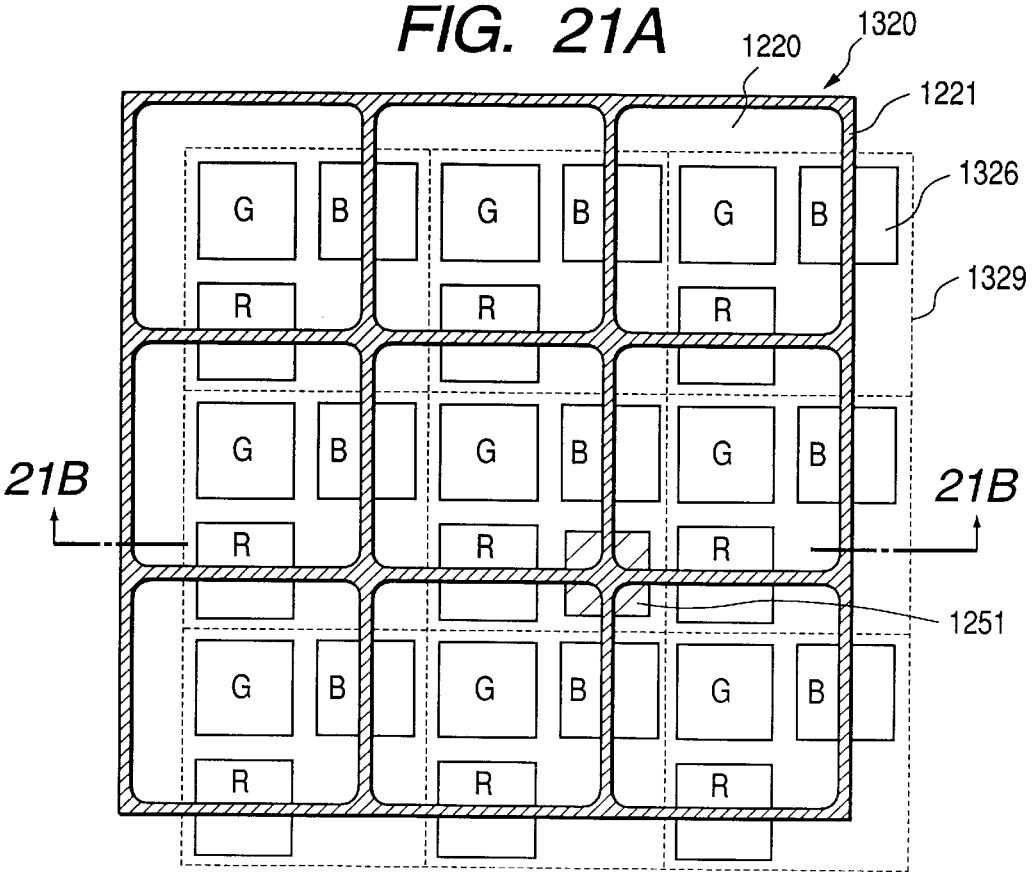
FIG. 21A is an enlarged partial plan view of still another embodiment of liquid crystal panel according to the invention.
Figure 21B:
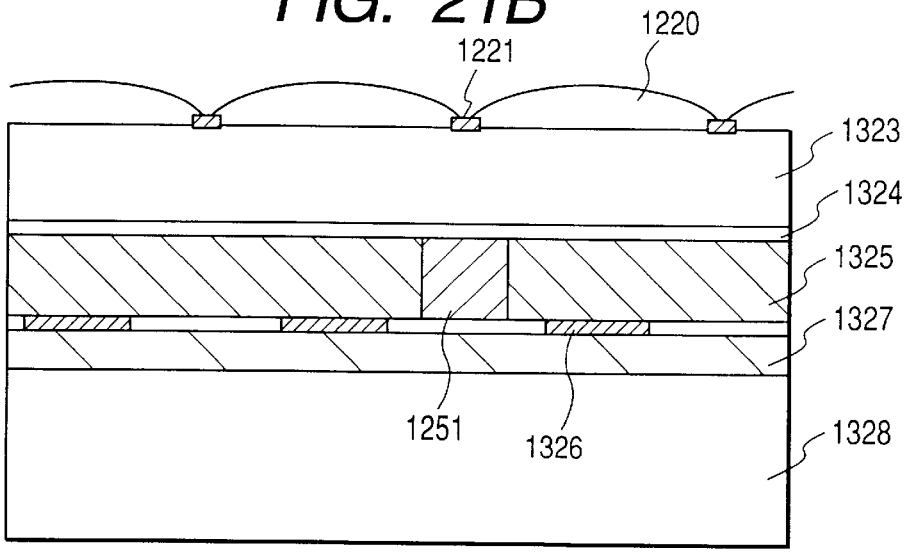
FIG. 21B is a schematic cross sectional view of the embodiment of liquid crystal panel of FIG. 21A.

FIG. 20 is an enlarged schematic partial cross sectional view of a fifth embodiment of liquid crystal panel 1320 according to the invention. This embodiment differs from the above described fourth embodiment in that a piece of sheet glass 1323 is used as opposite glass substrate and the micro-lenses 1220 are formed on the sheet glass 1323 by means of thermoplastic resin and a reflowing technique. Additionally, column spacers 1251 are formed in non-pixel areas by means of photosensitive resin and photolithography. FIG. 21A shows a schematic partial plan view of the liquid crystal panel 1320. As shown, the liquid crystal panel comprises micro-lenses 1220, a light shielding layer 1221, a glass sheet 1323, a transparent opposite electrode 1324, a liquid crystal layer 1325, pixel electrodes 1326, an active matrix drive circuit 1327 and a silicon semiconductor substrate 1328 arranged under a micro-lens substrate (not shown). The micro-lenses 1322 are formed on the surface of the glass substrate (made of alkali type glass) 1321 by means of so-called ion-exchange and arranged at a pitch twice as high as that of the pixel electrodes 1326 to produce a two-dimensional array. As seen from FIGS. 21A and 21B, column spacers 1251 are formed in non-pixel areas at selected corners of the micro-lenses 1220 at a predetermined pitch. FIG. 21B shows a schematic cross sectional view of the embodiment taken along line 21B–21B in FIG. 21A and across a column spacer 1251. Column spacers 1251 are preferably arranged at a pitch of every 10 to 100 pixels so as to show a matrix. Care has to be taken so that the number of column spacers can satisfy the two contradictory requirements of the planeness of the sheet glass 1323 and the pourability of liquid crystal. Still additionally, a light shielding layer 1221 of patterned metal film is arranged in this embodiment to prevent stray light from entering through boundary areas of the micro-lenses. This can effectively prevent any degradation of color saturation due to stray light and that of contrast (due to the effect of intermingled images of the three primary colors). Thus, a projection type display apparatus comprising the above embodiment of liquid crystal panel 1320 can display images of even higher quality particularly in terms of color saturation and contrast.

While the present invention is described above in terms of liquid crystal panels and projection type display apparatus, a front surface projection type projector or a rear surface projection type projector may also be realized by using a liquid crystal display apparatus comprising a liquid crystal panel and a drive means as described above to display high quality fine images.

ADVANTAGES OF THE INVENTION

Thus, according to the invention, a positive polarity image signal is written onto a pixel electrode by utilizing a pixel switch and/or a transfer switch comprising only a p-channel type transistor, whereas a negative polarity image signal is written onto a pixel electrode by utilizing a pixel switch and/or a transfer switch comprising only an n-channel type transistor to realize a low supply voltage and a reduced power consumption rate. Additionally, according to the invention, it is no longer necessary to use a circuit adapted to invert the polarity of image signal regularly and periodically to consequently simplify the overall circuit configuration. At the same time, polarity inversion can be realized on a line by line basis and field by field basis to produce high quality images.

Meanwhile, a projection type liquid crystal display apparatus according to the invention comprises a reflection type liquid crystal panel provided with micro-lenses and an optical system adapted to emit beams of light of the three primary colors in different respective directions but, once modulated and reflected by the liquid crystal, the beams from each picture unit of RGB pixels of moves through a same micro-lens. Then, the color images displayed by the apparatus are of high quality and free from a mosaic appearance of RGB.

Finally, the flux of light from each pixel is collimated as it passes through the micro-lens array twice so that a projection lens that has a small numerical aperture and hence is not expensive can be used to project bright images onto the screen.

What is claimed is:

1. An active matrix type liquid crystal display apparatus comprising a plurality of vertical signal lines, a Plurality of scanning lines crossing said plurality of vertical signal lines, a substrate carrying thereon a plurality of pixel electrodes connected to the respective crossings of said plurality of vertical signal lines and said plurality of scanning lines by way of respective transistors, a counter electrode substrate carrying thereon a counter electrode and liquid crystal pinched between said substrate and said counter substrate, wherein:

at least two transistors of different conductivity types are connected to each of said pixel electrodes and the source electrode or the drain electrode and the gate electrode of the transistor of the first conductivity type are connected respectively to a first vertical signal line and a first scanning line, whereas the source electrode or the drain electrode, whichever appropriate, and the gate electrode of the transistor of the second conductivity type different from the first conductivity type are connected respectively to a second vertical signal line and a second scanning line.

2. An active matrix type liquid crystal display apparatus according to claim 1, further comprising a control means adapted to select said first scanning line to bring the transistor of the first conductivity type into a conducting state and, simultaneously, said second scanning line of an adjacent row to bring the transistor of the second conductivity type into a conducting state.

3. An active matrix type liquid crystal display apparatus comprising a plurality of vertical signal lines, a plurality of scanning lines crossing said plurality of vertical signal lines, a plurality of pixel electrodes connected respectively to the crossings of said plurality of vertical signal lines and said plurality of scanning lines by way of respective switches, a counter electrode disposed vis-a-vis the pixel electrodes and liquid crystal pinched between said pixel electrodes said counter electrode, wherein:

each of the switches comprises at least two transistors of different conductivity types, the principal electrode of the transistor of the first conductivity type being connected to a first vertical signal line, the control electrode of the transistor of first conductivity type being connected to a first scanning line, the principal electrode of the transistor of the second conductivity type different from the first conductivity type being connected to a second vertical signal line, the control electrode of transistor of the second conductivity type being connected to a second scanning line, said first and second vertical signal lines and said first scanning line and said second scanning line of an adjacent row having polarities inverted relative to each other.

4. An active matrix type liquid crystal display apparatus according to claim 3, further comprising a control means adapted to select said first scanning line to bring the transistor of the first conductivity type into a conducting state and, simultaneously, said second scanning line of an adjacent row to bring the transistor of the second conductivity type into a conducting state.

5. An active matrix type liquid crystal display apparatus according to claim 3, wherein the transfer switch for transferring image signals to said first vertical signal line connected to the principal electrode of said transistor of the first conductivity type comprises a transistor of said first conductivity type, whereas the transfer switch for transferring image signals to said second vertical signal line connected to the principal electrode of said transistor of the second conductivity type comprises a transistor of said second conductivity type.

6. An active matrix type liquid crystal display apparatus according to claim 3, wherein the transfer switch for transferring image signals to said first vertical signal line connected to the principal electrode of said transistor of the first conductivity type comprises a transistor of said first conductivity type, whereas the transfer switch for transferring image signals to said second vertical signal line connected to the principal electrode of said transistor of the second conductivity type comprises a transistor of said second conductivity type.

7. An active matrix type liquid crystal display apparatus according to claim 3, wherein the image signal to be transferred to said first vertical signal line and the image signal to be transferred to said second vertical signal line have respective polarities that are inverted relative to each other.

8. An active matrix type liquid crystal display apparatus according to any of claims 1, 2 or 3 through 5, further comprising micro-lenses formed on the sheet glass on said counter electrode, each of said micro-lenses corresponds to three of said pixel electrodes.

9. An active matrix type liquid crystal display apparatus according to claim 8, wherein said micro-lenses are formed on a micro-lens glass substrate arranged on said sheet glass.

10. A projection type liquid crystal display apparatus, comprising a liquid crystal display apparatus according to claim 9.

11. A projection type liquid crystal display apparatus according to claim 10, wherein it comprises at least three liquid crystal panels for the three primary colors, wherein blue light is separated by a high reflection mirror and a blue light reflecting dichroic mirror and red light and green light are separated by a red light reflecting dichroic mirror and a green/blue light reflecting dichroic mirror before projected onto the respective liquid crystal panels.

* * * * *

UNITED STATES PATENT AND TRADEMARK OFFICE

CERTIFICATE OF CORRECTION

PATENT NO. : 6,266,038 B1
DATED : July 24, 2001
INVENTOR(S) : Daisuke Yoshida et al.

It is certified that error appears in the above-identified patent and that said Letters Patent is hereby corrected as shown below:

Column 1,
Line 24, “rystal” should read -- crystal --;
Line 63, “raise” should read -- raises --.

Column 4,
Line 31, “an-adjacent” should read -- an adjacent --;
Line 37, “a still” should read -- still --;
Line 46, “projected” should read -- being projected --;
Line 63, “illustration” should read -- illustrations --.

Column 8,
Line 22, “are-schematic” should read -- are schematic --;
Line 32, “reflecting dichroic mirror” should be deleted;
Line 66, “than” should read -- other than --;
Line 67, “reflected” should read -- is reflected --.

Column 9,
Line 26, “proceeds” should read -- proceed --;
Line 31, “450” should read -- 45º -- (not bold);
Line 36, “reflected” should read -- are reflected --.

Column 10,
Line 21, “shows” should read -- show --.

Column 12,
Line 27, “correspond” should read -- corresponds --.

Column 15,
Line 27, “of moves” should read -- move --;
Line 37, “Plurality” should read -- plurality --.

UNITED STATES PATENT AND TRADEMARK OFFICE

CERTIFICATE OF CORRECTION

PATENT NO. : 6,266,038 B1
DATED : July 24, 2001
INVENTOR(S) : Daisuke Yoshida et al.

It is certified that error appears in the above-identified patent and that said Letters Patent is hereby corrected as shown below:

Column 16,
Line 3, “electrodes” should read -- electrodes and --;
Line 48, “claims 1, 2 or 3 through 5,” should read -- claims 1-6 --;
Line 50, “each” should read -- wherein each --;
Line 64, “projected” should read -- being projected --.

Signed and Sealed this

Eleventh Day of June, 2002

*Attest:*

*Attesting Officer*

JAMES E. ROGAN
*Director of the United States Patent and Trademark Office*